US012276115B2

(12) United States Patent
Goetz et al.

(10) Patent No.: US 12,276,115 B2
(45) Date of Patent: Apr. 15, 2025

(54) HOLLOW BUILDING SURFACE PANEL AND BUILDING SURFACE SYSTEM

(71) Applicant: CertainTeed LLC, Malvern, PA (US)

(72) Inventors: Robert L. Goetz, Marshall, MI (US); Brian W. Kirn, Hatboro, PA (US); David J. Stucky, Grass Lake, MI (US); Mark G. Suchyna, Buffalo, NY (US); Jason Ferris, Frederick, MD (US); Mark J. Dunmire, Buffalo, NY (US)

(73) Assignee: CertainTeed LLC, Malvern, PA (US)

( * ) Notice: Subject to any disclaimer, the term of this patent is extended or adjusted under 35 U.S.C. 154(b) by 39 days.

(21) Appl. No.: 17/938,116

(22) Filed: Oct. 5, 2022

(65) Prior Publication Data

US 2023/0167645 A1 Jun. 1, 2023

Related U.S. Application Data

(60) Provisional application No. 63/252,265, filed on Oct. 5, 2021.

(51) Int. Cl.
*E04B 2/00* (2006.01)
*E04F 13/08* (2006.01)

(52) U.S. Cl.
CPC ..... *E04F 13/0894* (2013.01); *E04F 13/0851* (2013.01)

(58) Field of Classification Search
CPC ..... E04F 13/0894; E04F 13/0851
See application file for complete search history.

(56) References Cited

U.S. PATENT DOCUMENTS

| | | | | |
|---|---|---|---|---|
| 3,236,932 | A * | 2/1966 | Grigas | E04F 13/0803 52/522 |
| 3,606,720 | A * | 9/1971 | Cookson | E04D 3/3607 52/489.1 |
| 6,195,952 | B1 * | 3/2001 | Culpepper | E04F 13/0864 52/522 |
| D487,316 | S * | 3/2004 | Suwanda | D25/138 |
| D550,376 | S * | 9/2007 | Hein | D25/126 |
| 8,387,325 | B2 | 3/2013 | Mullet | |
| D684,705 | S * | 6/2013 | Curtas | D25/138 |

(Continued)

OTHER PUBLICATIONS

Sagiper North America, Sagiwall Installation Guidelines, Jan. 1, 2017.

(Continued)

*Primary Examiner* — Basil S Katcheves
(74) *Attorney, Agent, or Firm* — McDonnell Boehnen Hulbert & Berghoff LLP

(57) ABSTRACT

The present disclosure relates generally to building surface panels, for example, suitable for covering a support structure of a building. The present disclosure relates more particularly to a building surface panel including a hollow panel body, a fastening strip attached to the panel body, and an overhang attached to the panel body and extending along the lower side of the building surface panel. The building surface panel includes a rear-facing engagement surface disposed at the upper side of the building surface panel and a front-facing engagement surface disposed at the lower side of the building surface panel. The front facing engagement surface is configured to engage a rear facing engagement surface of a lower neighboring building surface panel.

20 Claims, 20 Drawing Sheets

(56) References Cited

U.S. PATENT DOCUMENTS

| | | | | |
|---|---|---|---|---|
| D686,347 | S * | 7/2013 | Raivio | D25/138 |
| 8,516,765 | B2 | 8/2013 | Shaw | |
| 8,640,410 | B2 * | 2/2014 | Bergeron | E04B 1/14 52/592.1 |
| 8,769,904 | B1 * | 7/2014 | Brandt | E04C 2/46 52/177 |
| 9,540,800 | B2 * | 1/2017 | Laurindo | E04F 13/072 |
| 10,041,243 | B2 * | 8/2018 | Walker | E04B 1/7604 |
| 10,184,254 | B2 * | 1/2019 | Piché | E04F 13/0894 |
| D896,986 | S * | 9/2020 | Feng | D25/38.1 |
| 2006/0053716 | A1 * | 3/2006 | Mowery | E04F 13/18 52/309.8 |
| 2007/0062146 | A1 * | 3/2007 | Van Dijk | E04C 2/22 52/580 |
| 2007/0181865 | A1 * | 8/2007 | Hein | E04H 17/16 256/24 |
| 2008/0010924 | A1 * | 1/2008 | Pietruczynik | B29C 48/001 52/309.1 |
| 2010/0032861 | A1 | 2/2010 | Pietruczynik | |
| 2012/0213974 | A1 * | 8/2012 | Olvey | E04C 2/296 428/167 |
| 2012/0319067 | A1 * | 12/2012 | Millar | E04H 17/1439 256/19 |
| 2014/0123585 | A1 * | 5/2014 | Desch | E04F 13/0801 52/506.05 |
| 2016/0340909 | A1 * | 11/2016 | Riebel | E04F 13/0846 |
| 2020/0080306 | A1 * | 3/2020 | Richardson | E04B 9/0457 |

OTHER PUBLICATIONS

Certain Teed Corporation, ICON(TM)—The New Standard in Siding, Aug. 2017.

Certain Teed Corporation, ICON(TM) Composite Siding Installation Instructions, Aug. 2016.

Longboard Products, Longboard(R) Inspiring Facades, 2020.

Royal(R) Building Products, Cedar Renditions by Royal(R), 2020.

Royal(R) Building Products, Cedar Renditions(TM) Design Series Installation Instructions, 2020.

* cited by examiner

HOLLOW BUILDING SURFACE PANEL AND BUILDING SURFACE SYSTEM

BACKGROUND OF THE DISCLOSURE

1. Field of the Disclosure

The present disclosure relates generally to cladding for covering a building surface. The present disclosure relates more particularly to a hollow building surface panels that couple to one another.

2. Technical Background

Building surface panels, such as cladding or siding, are visible elements that cover an underlying support structure. The panels can provide protection of the support structure and also form the visible facade of the wall or other building surface. Siding panels are typically configured to be attached directly to the support structure, for example, using mechanical fasteners, adhesive, or another attachment method. In addition, siding panels often interconnect to one another, which strengthens the structural integrity of the surface and the overall connection of the panels to the support structure.

Many siding panels are formed by a single layer of material that is bent and folded to form upper and lower locks and profiled surface. This single layer construction can present challenges for making panels with certain shapes. For example, a siding panel formed by a single layer with a wide flat visible surface may be vulnerable to buckling. One option to add strength to the panel is to include a foam support layer behind the front layer of material. However, the inclusion of such a support layer adds complexity to the manufacturing process and requires additional materials.

The present inventors have recognized that building surface panels with an alternative construction that provides improved strength and a suitable design for connecting adjacent panels would be attractive to builders and customers by providing a more uniform surface with a larger variety of aesthetics.

SUMMARY OF THE DISCLOSURE

In one aspect, the present disclosure provides a building surface panel having a first end, a second end, an upper side, and a lower side, the building surface panel comprising:

- a hollow panel body including a front wall and a rear wall that enclose an interior space;
- a fastening strip attached to the panel body and extending along the upper side of the building surface panel, wherein the fastening strip and the rear wall of the panel body form a rear attachment surface of the building surface panel that is configured to engage a support structure;
- an overhang attached to the panel body and extending along the lower side of the building surface panel, the overhang being configured to overlap at least a portion of a fastening strip of a lower neighboring building surface panel having a similar configuration, wherein the overhang and the front wall of the panel body form an exposed front surface of the building surface panel,
- a rear-facing engagement surface disposed at the upper side of the building surface panel; and
- a front-facing engagement surface disposed at the lower side of the building surface panel, the front facing engagement surface being configured to engage a rear facing engagement surface of the lower neighboring building surface panel.

In another aspect, the disclosure provides a building surface system comprising:

- a support structure;
- an upper building surface panel according to the disclosure secured to the support structure; and
- a lower building surface panel according to the disclosure secured to the support structure,
- wherein the front-facing engagement surface at the lower side of the upper building surface panel is secured against the rear-facing engagement surface at the upper side of the lower building surface panel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that building surface panels with an alternative construction that provides improved strength and a suitable design for connecting adjacent panels would be attractive to builders and customers.

Accordingly, one aspect of the disclosure is a building surface panel having a first end, a second end, an upper side, and a lower side. The building surface panel includes a hollow panel body including a front wall and a rear wall that enclose an interior space. A fastening strip is attached to the panel body and extends along the upper side of the building surface panel. Together, the fastening strip and the rear wall of the panel body form a rear attachment surface of the building surface panel that is configured to engage a support structure. The building surface panel also includes an overhang attached to the panel body that extends along the lower side of the building surface panel. The overhang is configured to overlap at least a portion of a fastening strip of a lower neighboring building surface panel that has a similar configuration. Together, the overhang and the front wall of the panel body form an exposed front surface of the building surface panel. The building surface panel also includes a rear-facing engagement surface disposed at the upper side of the building surface panel and a front-facing engagement surface disposed at the lower side of the building surface panel. The front facing engagement surface is configured to engage a rear facing engagement surface of the lower neighboring building surface panel.

Figure 1A:
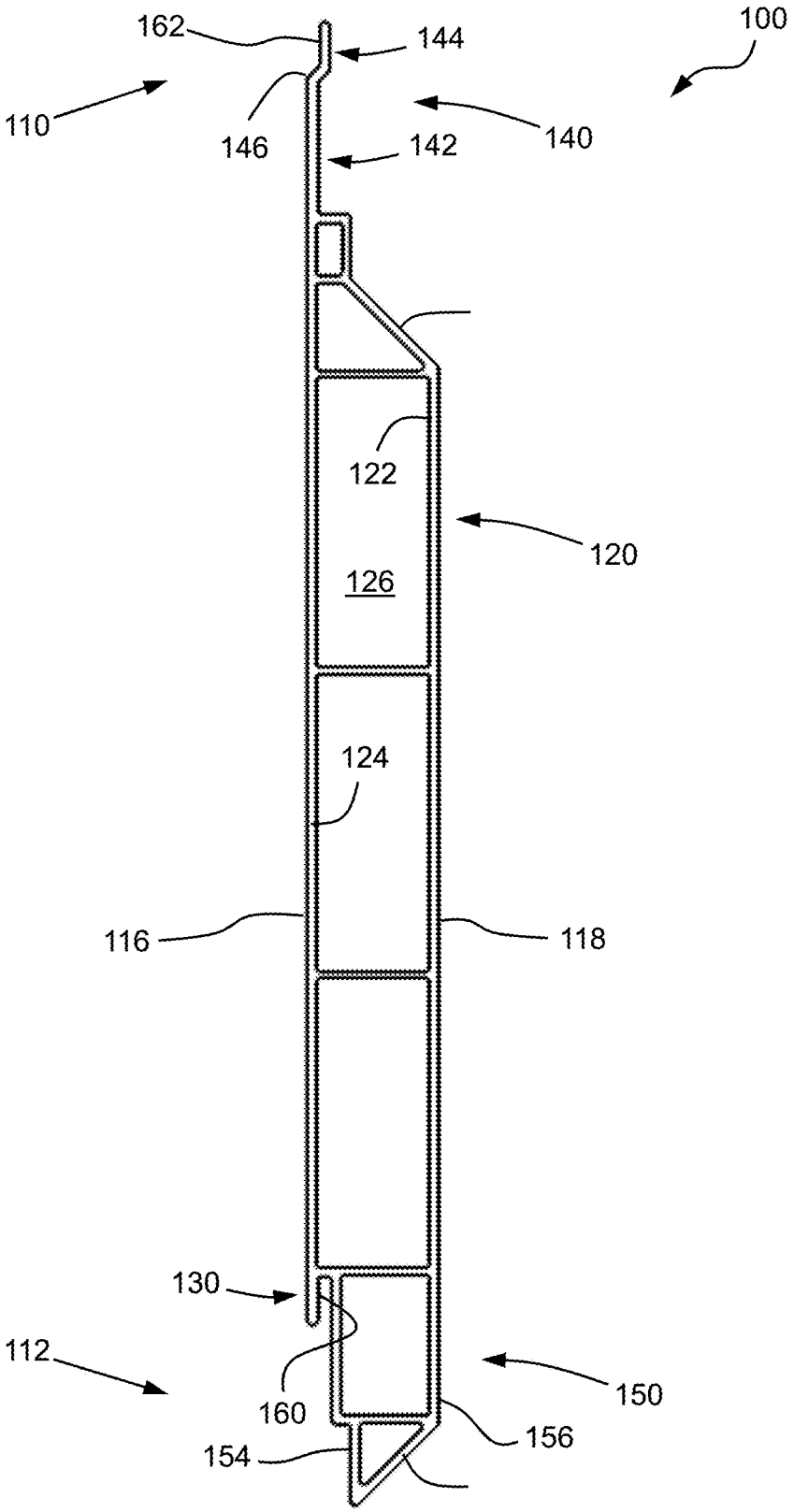
FIG. 1A is a cross-sectional view building surface panel according to an embodiment of the disclosure.
Figure 1B:
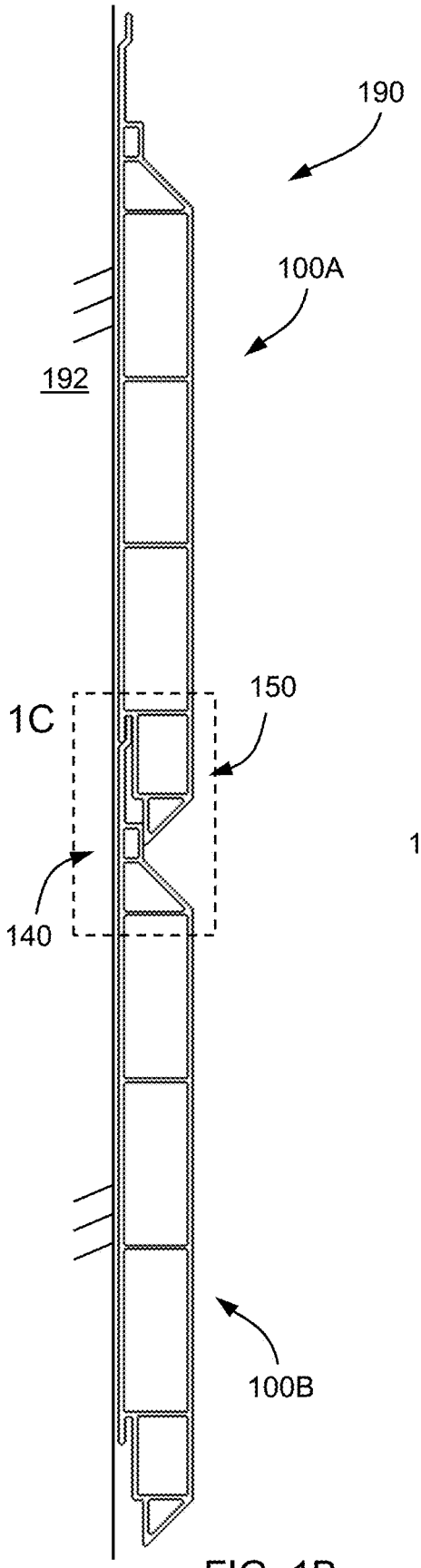
FIG. 1B is a cross-sectional view of a building surface system including a pair of building surface panels according to FIG. 1A secured to a support structure in accordance with an embodiment of the disclosure.
Figure 1C:
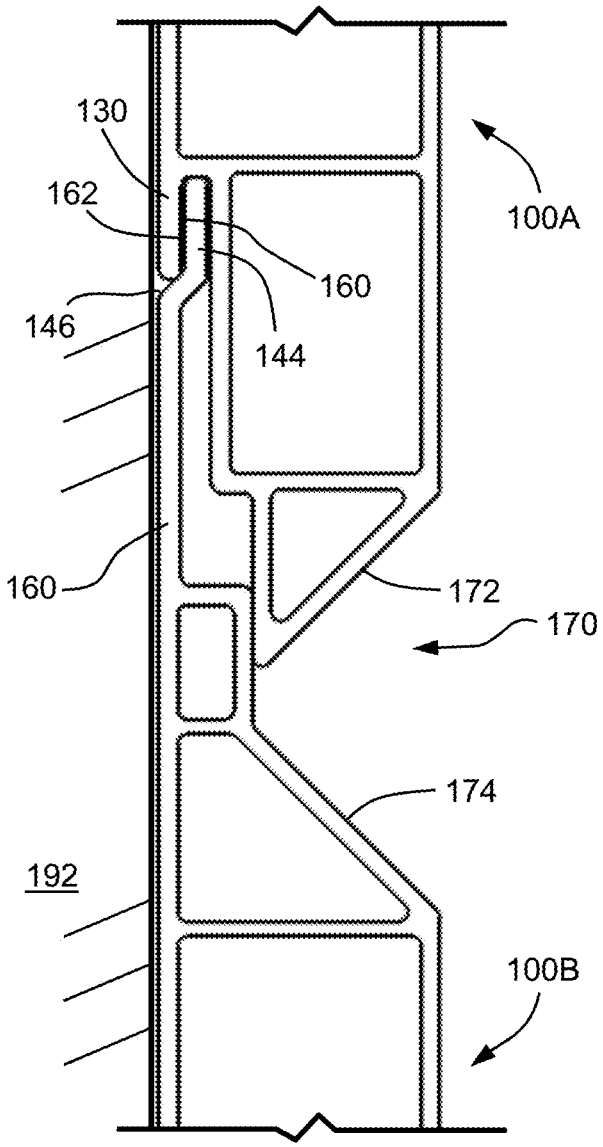
FIG. 1C is an enlarged view of a portion of FIG. 1B.
Figure 1D:
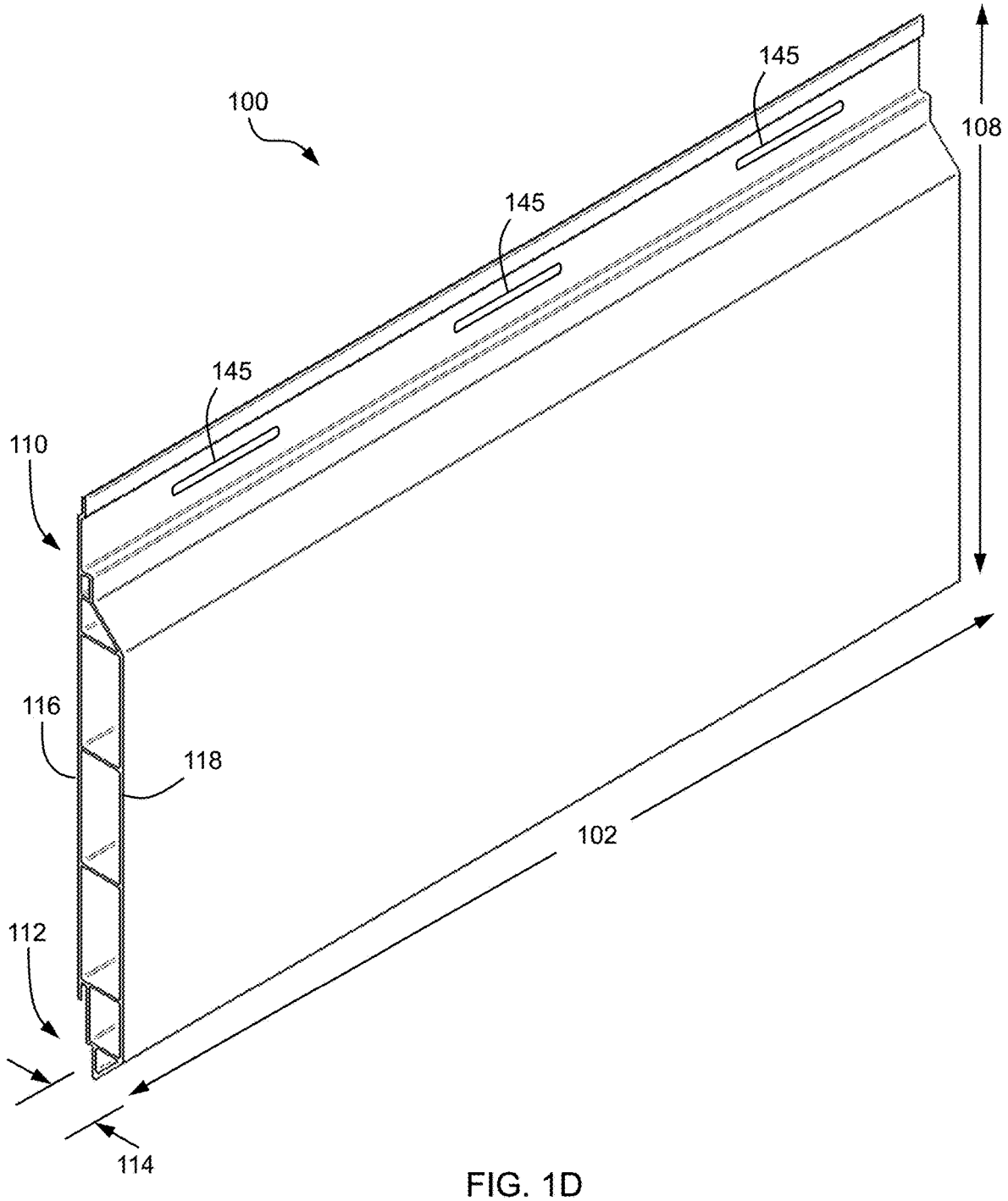
FIG. 1D is a perspective view of the building surface panel of FIG. 1A.

FIG. 1A shows a cross-sectional view of such a building surface panel 100 and FIG. 1D shows a schematic perspective view of building surface panel 100. In order to show details of building surface panel 100, the length of building surface panel is only schematically represented in FIG. 1D and is not to scale.

As shown in FIG. 1D, building surface panel 100 has a longitudinal configuration that extends along a length 102 from a first end 104 to a second end 106 and extends across a width 108 from an upper side 110 to a lower side 112. FIG. 1D also illustrates the thickness 114 of building surface panel 100 between a rear attachment surface 116 configured to be secured against a support structure (see FIGS. 1B, 1C and 1E) and an exposed front surface 118 that is configured to be visible when building surface panel 100 is attached to the support structure.

As shown in FIG. 1A, building surface panel 100 includes a hollow panel body 120 that includes a front wall 122 and a rear wall 124 that enclose an interior space 126 between front wall 122 and rear wall 124. The hollow construction of panel body 120 can provide structural support across the width of panel body 120. Accordingly, panel body 120 may be resistant to buckling and can therefore span larger widths than other building surface panels. Moreover, the hollow construction also allows for the panels to have sharper corners and a wider range of geometries than traditional building surface panel constructions.

A fastening strip 140 is attached to panel body 120 and extends along the upper side 110 of the building surface panel 100. Along with the rear wall 124 of panel body 120, fastening strip 140 also forms a part of the rear attachment surface 116 that is configured to be placed against a support structure. Moreover, fastening strip 140 is configured to secure building surface panel 100 to the support structure, for example using a fastener that extends through fastening strip 140.

Building surface panel 100 also includes an overhang 150 attached to panel body 120 that extends along the lower side 112 of building surface panel 100. Overhang 150 is configured to overlap at least a portion of a fastening strip of a lower neighboring building surface panel that has a similar configuration, as explained in more detail below with reference to the building surface system shown in FIGS. 1B, 1C and 1E.

Building surface panel 100 also includes a rear-facing engagement surface 162 disposed at the upper side 110 of the building surface panel and a front-facing engagement surface 160 disposed at the lower side 112 of the building surface panel 100. The front-facing engagement surface 160 is configured to engage a rear facing engagement surface of the lower neighboring building surface panel, while the rear-facing engagement surface 162 is configured to engage a front-facing engagement surface of an upper neighboring building surface panel.

In another aspect, the disclosure provides a building surface system that includes a support structure, an upper building surface panel according to the disclosure secured to the support structure and a lower building surface panel according to the disclosure secured to the support structure. The front-facing engagement surface at the lower side of the upper building surface panel is secured against the rear-facing engagement surface at the upper side of the lower building surface panel.

Figure 1E:
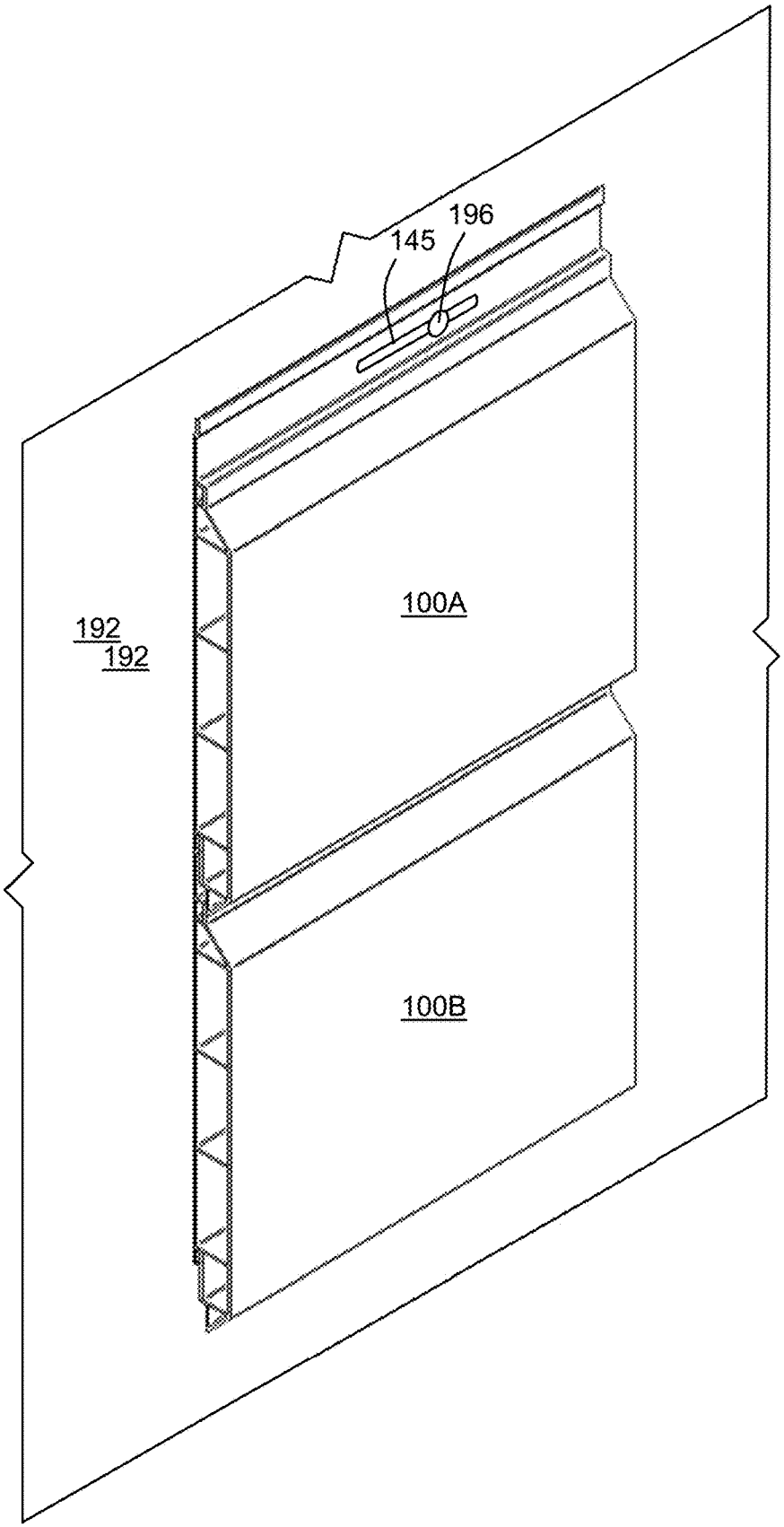
FIG. 1E is a perspective view of a building surface system including building surface panels of FIG. 1A, according to an embodiment of the disclosure.

For example, FIG. 1B shows a cross-sectional view of a building surface system 190 including an upper building surface panel 100A connected to a lower building surface panel 100B, where each of upper building surface panel 100A and lower building surface panel 100B has the same configuration as building surface panel 100, shown in FIG. 1A. FIG. 1C shows an enlarged cross-sectional view of the area in the vicinity of the connection between upper building surface panel 100A and lower building surface panel 100B. Further, FIG. 1E shows a perspective view of the building surface system 190. In order to show details of building surface system 190, the lengths of the upper building surface panel 100A and the lower building surface panel 100B in the perspective view of FIG. 1E are only schematically represented and are not to scale.

As shown in FIG. 1C, upper building surface panel 100A and lower building surface panel 100B are connected and both have the same configuration as building surface panel 100. Further, overhang 150 of upper building surface panel 100A extends downward to the top of panel body 120 of lower building surface panel 100B of so as to overlap fastening strip 140 of lower building surface panel 100B. Accordingly, overhang 150 of upper building surface panel 100A forms a portion of the exposed front surface 118 of upper building surface panel 100A while the fastening strip 140 of lower building surface panel 100B, as well as any fasteners used to hold it against a support structure, may be obscured from view.

The upper building surface panel 100A and the lower building surface panel 100B interact in that front-facing engagement surface 160 of upper building surface panel 100A is placed against rear-facing engagement surface 162 of lower building surface panel 100B. The interaction between front-facing engagement surface 160 of upper building surface panel 100A and rear-facing engagement surface 162 of lower building surface panel 100B may help to keep the lower side 112 of upper building surface panel 100A against the support structure and prevent the lower side 112 from flaring outward away from the support structure. For example, in view of the proximity of rear-facing engagement surface 162 to fastening strip 140 at the upper side 110 of lower building surface panel 100B, rear-facing engagement surface 162 will be held securely against the support structure. In turn, the rear-facing engagement surface 162 of lower building surface panel 100B can hold the lower side 112 of upper building surface panel 100A by pressing against front-facing engagement surface 160 of the upper building surface panel 100A.

The interaction between the rear-facing engagement surface 162 of lower building surface panel 100B and the front-facing engagement surface 160 of upper building surface panel 100A provides a broad connection between the two panels, thereby securely retaining the upper building surface panel 100A in place. It should be understood that each of the rear-facing engagement surface 162 and front-facing engagement surface 160 abut one another over a broader area than a mere edge of one of the material walls of the panels. For example, the extent of the contact between rear-facing engagement surface and front-facing engagement surface may be substantially greater than the material thickness of the building surface panel. For example, the breadth of the contact between the rear-facing engagement surface and the front-facing engagement surface, with respect to a cross-section of the building surface panels, may be at least 3 times the material thickness of the panels, or at least 5 times the material thickness of the panels, or at least 10 times the thickness of the panels. Accordingly, the engagement between the rear-facing engagement surface and the front-facing engagement surface may be substantially wider than afforded by an edge of the material.

In certain embodiments of the building surface panel as otherwise described herein, the panel body includes a lower projection that extends downward behind the overhang, and the front-facing engagement surface is formed on the lower projection of the panel body. For example, panel body 120 of building surface panel 100 includes a lower projection 130 that extends downward behind overhang 150 and rear-facing engagement surface 162 is disposed on lower projection 130. Accordingly, lower projection 130 and the associated rear-facing engagement surface 162 may be near the bottom edge at the lower side 112 of building surface panel 100.

In certain embodiments of the building surface panel as otherwise described herein, the fastening strip includes an attachment section that forms a portion of the rear attachment surface of the building surface panel, and an upper projection that extends upward from the attachment section and forward from the rear attachment surface, and where the rear-facing engagement surface is formed on the upper projection. For example, the fastening strip 140 of building surface panel 100 includes an attachment section 142 and an upper projection 144 that extends upward from attachment section 142. The attachment section 142 is the portion of fastening strip 140 that is configured to secure building surface panel 100 against a support structure and therefore forms part of rear attachment surface 116 of building surface panel 100. From attachment section 142, upper projection 144 extends forward from rear attachment surface 116. As shown in FIG. 1C, the forward advancement of upper projection 144 of lower building surface panel 100B provides a space for the front-facing engagement surface 160 of upper building surface panel 100A to be positioned behind the upper projection 144 and against the rear-facing engagement surface 162 of lower building surface panel 100B.

In certain embodiments of the building surface panel as otherwise described herein, the lower projection is formed by a flange. For example, lower projection 130 of panel body 120 is formed by a flange that is configured as an extension of rear wall 124. Thus, lower projection 130 also forms part of the rear attachment surface 116 that is secured to the support structure. Accordingly, as shown in FIG. 1C, the upper projection 144 of lower building surface panel 100B effectively pins the lower projection 130 of upper building surface panel 100A against the support structure with the rear-facing engagement surface 162 of upper projection 144 pressed against the front-facing engagement surface 160 of lower projection 130.

In certain embodiments of the building surface panel as otherwise described herein, the flange is formed by a single wall. For example, the flange that forms lower projection 130 of panel body 120 in building surface panel 100 is formed by a single wall of material. The phrase single wall, as used herein, refers to a solid construction where the wall is completely filled with material from front surface of the wall to a back surface of the wall. Thus, a single wall construction, as used herein, is distinct from a hollow construction, which may include separate walls that are spaced apart from one another. The phrase single wall, however, is not intended to exclude a construction where the wall is made of multiple layers of either the same or different materials that are stacked adjacent to one another. Moreover, the phrase single wall is not intended to exclude constructions where the wall may have apertures or holes that extend through the wall, and instead is only intended to be distinguished from constructions of separate walls or layers that are spaced apart to form a hollow interior.

Figure 2A:
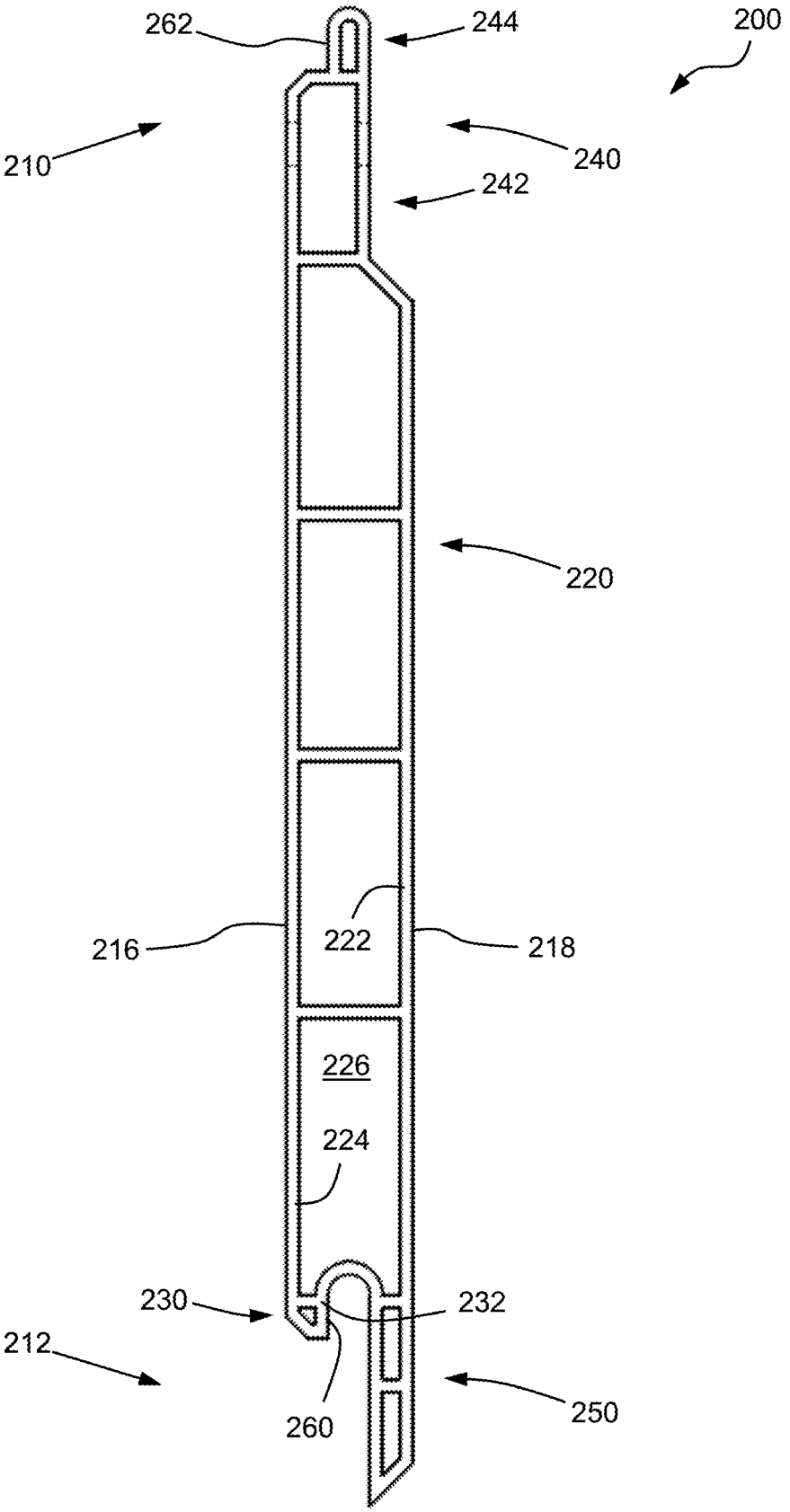
FIG. 2A is a cross-sectional view building surface panel according to an embodiment of the disclosure.
Figure 2B:
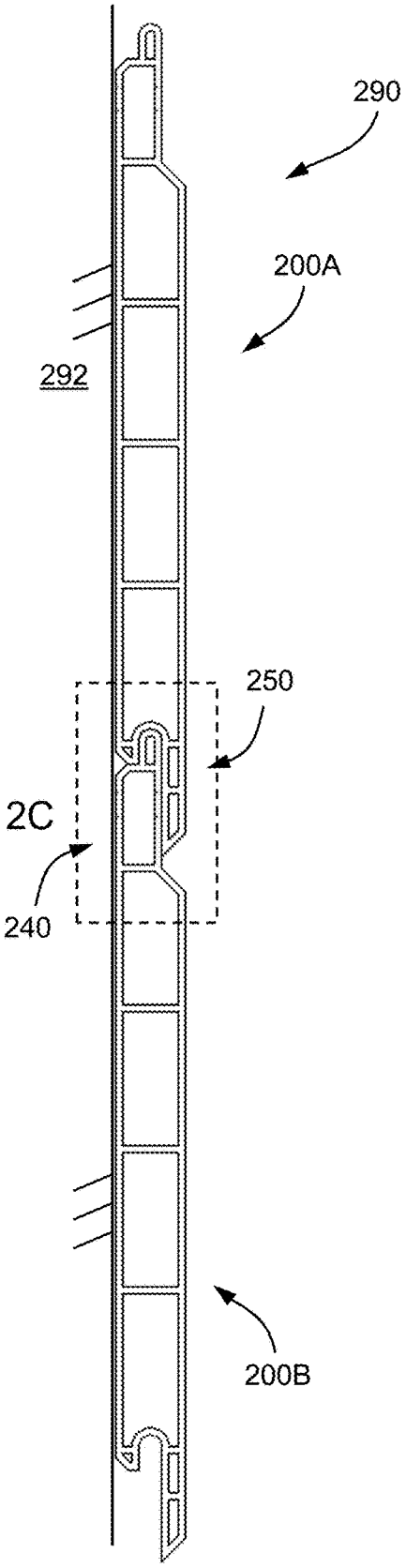
FIG. 2B is a cross-sectional view of a building surface system including a pair of building surface panels according to FIG. 2A secured to a support structure in accordance with an embodiment of the disclosure.
Figure 2C:
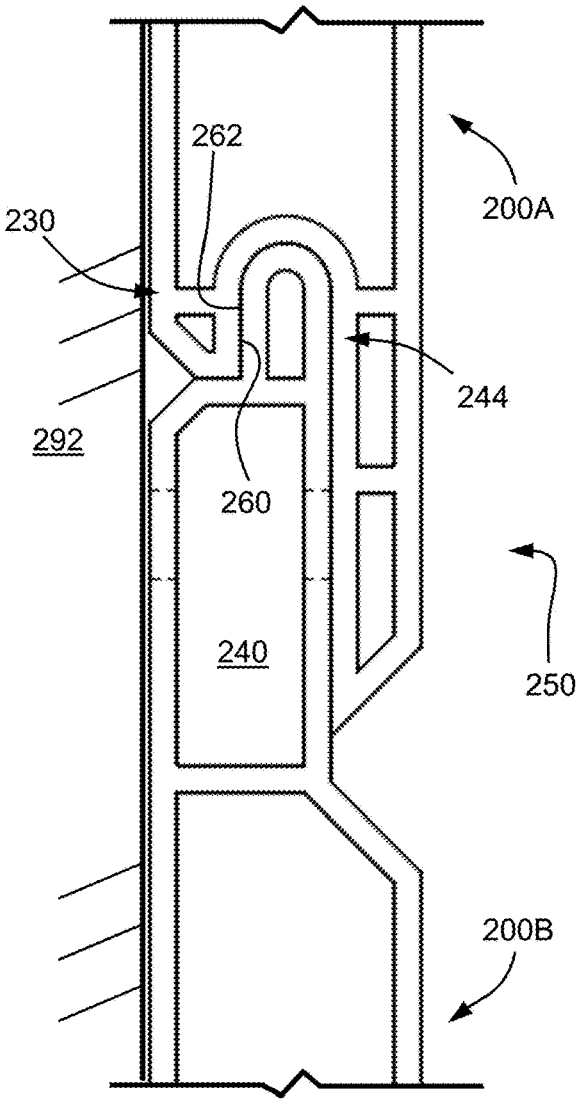
FIG. 2C is an enlarged view of a portion of FIG. 2B.

That said, in certain embodiments of the building surface panel as otherwise described herein, the flange is hollow. A building surface panel having such a construction is shown in FIGS. 2A-2C. As shown in FIG. 2A, building surface panel 200 includes a panel body 220 formed by a front wall 222 and a rear wall 224 with a hollow interior space 226 between front wall 222 and rear wall 224. A fastening strip 240 is attached to panel body 220 along the upper side 210 of building surface panel 200 and extends upward from panel body 220. Likewise, an overhang 250 is attached to panel body 220 along the lower side 212 of building surface panel 200 and extends downward from panel body 220. Rear wall 224 of panel body 220 and fastening strip 240 form a rear attachment surface 216 of building surface panel 200. On the other hand, front wall 222 of panel body 220 and overhang 250 form an exposed front surface 218 of building surface panel 200.

Fastening strip 240 and overhang 250 are configured such that adjacent building surface panels having the same construction as building surface panel 200 will overlap and connect to one another. For example, FIG. 2B shows a building surface system 290 including an upper building surface panel 200A connected to a lower building surface panel 200B, where each of upper building surface panel 200A and lower building surface panel 200B have the same construction as building surface panel 200 of FIG. 2A. As shown in FIG. 2B, fastening strip 240 of lower building surface panel 200B is placed against a support structure 292 so that it may be secured to support structure 292 using a mechanical fastener. With fastening strip 240 of lower building surface panel 200B against support structure 292, overhang 250 of upper building surface panel 200A hangs down in front of fastening strip 240 of lower building surface panel 200B, such that overhang 250 of upper building surface panel 200A and fastening strip 240 of lower building surface panel 200B overlap. FIG. 2C shows an enlarged view of FIG. 2B to illustrate the connection between upper building surface panel 200A and lower building surface panel 200B.

As shown in FIG. 2A, panel body 220 of building surface panel 200 includes a lower projection 230 in the form a flange that extends downward the rear attachment surface 216. The flange forming lower projection 230 has a hollow construction that is formed by rear wall 224 of panel body 220 and a front wall 232 that forms the front-facing engagement surface 260 of building surface panel 200. A space is provided between front wall 232 of lower projection 230 and rear wall 224 so as to provide the hollow construction. At the upper side 210 of building surface panel 200, fastening strip 240 includes an upper projection 244 that extend vertically upward from an attachment section 242 of the fastening strip 240. Upper projection 244 includes a rear-facing engagement surface 262 that is configured to be secured against the front-facing engagement surface of a neighboring building surface panel.

For example, as shown in FIG. 2C, fastening strip 240 of lower building surface panel 200B is secured against support structure 292, thereby holding upper projection 244 of lower building surface panel 200B securely in place. Lower projection 230 of upper building surface panel 200A is positioned behind upper projection 244 of lower building surface panel 200B such that the rear-facing engagement surface 262 of lower building surface panel 200B is placed against the front-facing engagement surface 260 of the lower projection 230 of upper building surface panel 200A so as to hold the upper building surface panel 200A against support structure 292.

In certain embodiments of the building surface panel as otherwise described herein, a portion of the upper projection of the fastening strip extends vertically and is offset from the rear attachment surface so as to provide a pocket behind the upper projection.

For example, the attachment section 142 of fastening strip 140 of building surface panel 100 extends vertically along the rear attachment surface 116 to a bend 146, where upper projection 144 begins. From bend 146, upper projection 144 extends forward over a short distance before bending again and extending vertically at a distance that is offset from rear attachment surface 116. Accordingly, a pocket is formed behind upper projection 144. As shown in FIG. 1C, the pocket behind upper projection 144 of lower building surface panel 100B provides a space for lower projection 130 of upper building surface panel 100A to be inserted. With the lower projection 130 of upper building surface panel 100A inserted behind upper projection 144 of lower building surface panel 100B, the two panels are connected and the lower side 112 of upper building surface panel 100A may be secure.

Likewise, the upper projection 244 of fastening strip 240 of building surface panel 200 is thinner than the attachment section 242. Moreover, upper projection 244 is aligned with the front surface of attachment section 242 and spaced from the rear surface of attachment section 242, which is aligned with rear attachment surface 216. Accordingly, a pocket is provided behind upper projection 244 for insertion of a lower projection of a neighboring upper panel, as shown in FIG. 2C.

In certain embodiments of the building surface panel as otherwise described herein, the lower projection is formed by an angled lower wall of the panel body. Likewise, in some embodiments, the upper projection of the fastening strip extends outward at an angle to the attachment section of the fastening strip.

Figure 3A:
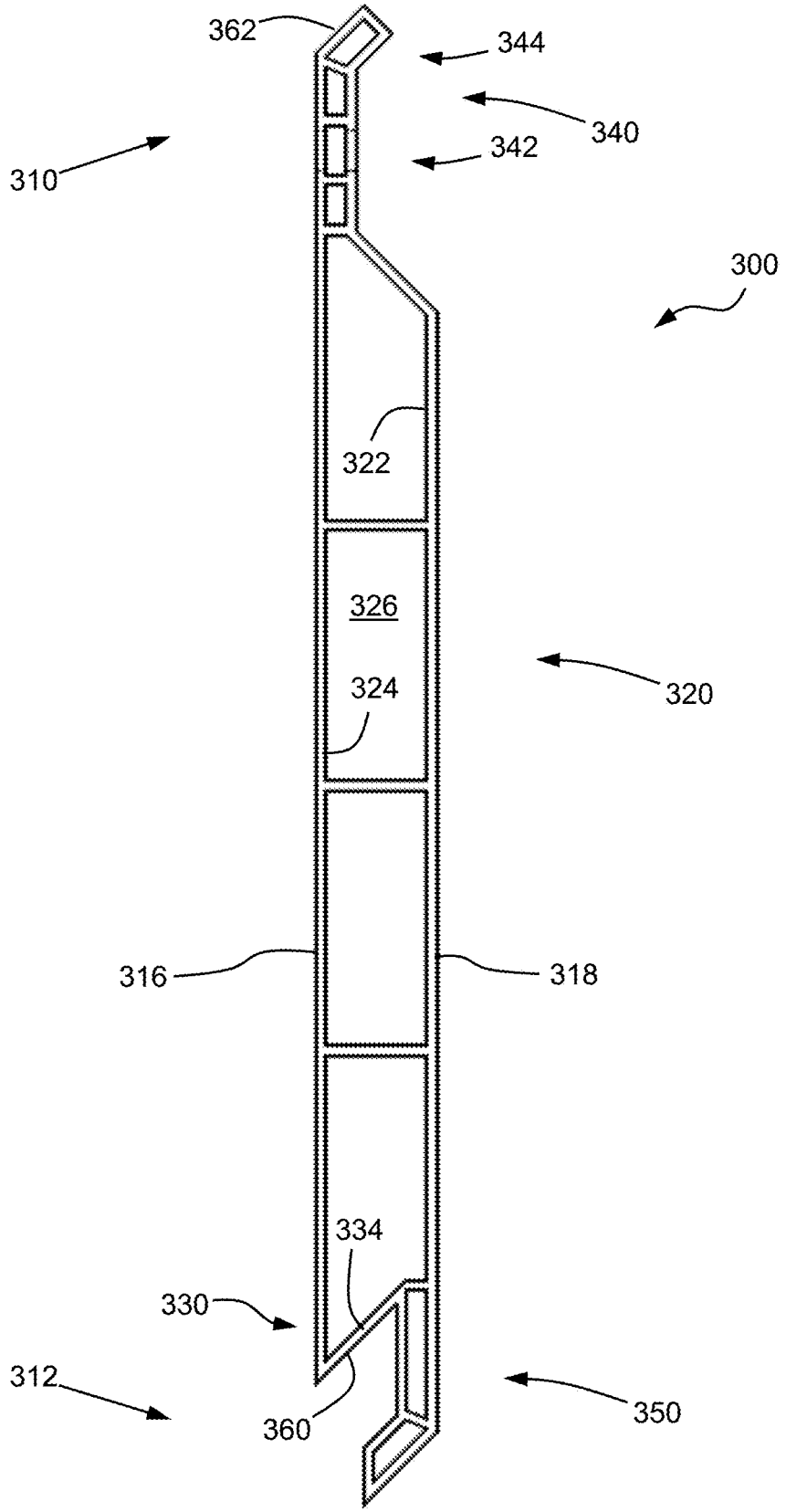
FIG. 3A is a cross-sectional view building surface panel according to an embodiment of the disclosure.
Figure 3B:
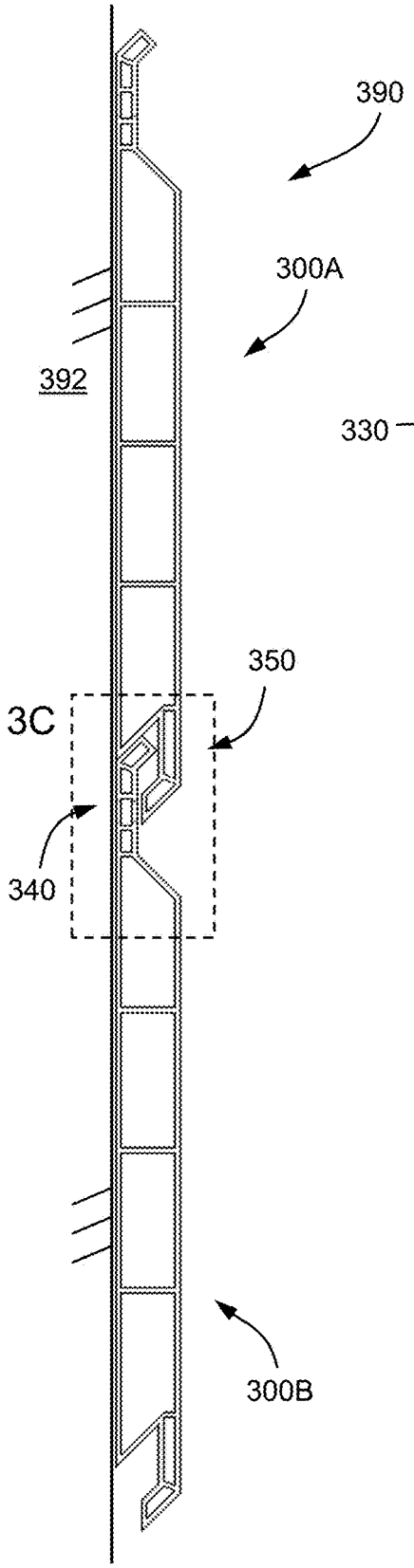
FIG. 3B is a cross-sectional view of a building surface system including a pair of building surface panels according to FIG. 3A secured to a support structure in accordance with an embodiment of the disclosure.
Figure 3C:
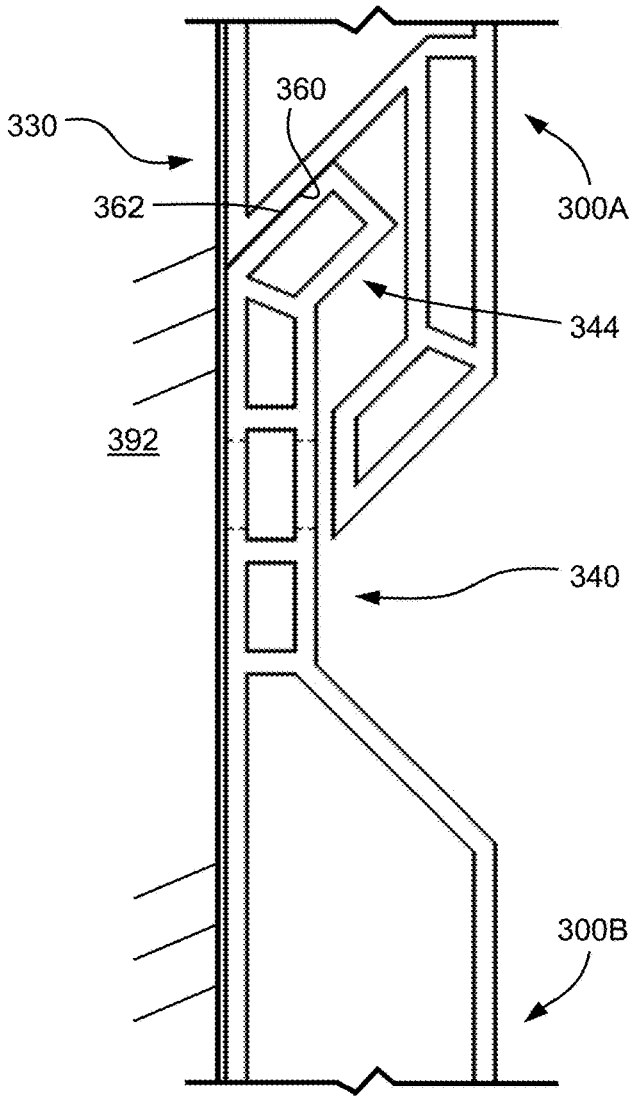
FIG. 3C is an enlarged view of a portion of FIG. 3B.

Such a building surface panel is shown in FIGS. 3A-3C. As shown in FIG. 3A, building surface panel 300 includes a panel body 320 formed by a front wall 322 and a rear wall 324 with a hollow interior space 326 between front wall 322 and rear wall 324. A fastening strip 340 is attached to panel body 320 along the upper side 310 of building surface panel 300 and extends upward from panel body 320. Likewise, an overhang 350 is attached to panel body 320 along the lower side 312 of building surface panel 300 and extends downward from panel body 320. Rear wall 324 of panel body 320 and fastening strip 340 form a rear attachment surface 316 of building surface panel 300. On the other hand, front wall 322 of panel body 320 and overhang 350 form an exposed front surface 318 of building surface panel 300.

Fastening strip 340 and overhang 350 are configured such that adjacent building surface panels having the same construction as building surface panel 300 will overlap and connect to one another. For example, FIG. 3B shows a building surface system 390 including an upper building surface panel 300A connected to a lower building surface panel 300B, where each of upper building surface panel 300A and lower building surface panel 300B have the same construction as building surface panel 300 of FIG. 3A. As shown in FIG. 3B, fastening strip 340 of lower building surface panel 300B is placed against a support structure 392 so that it may be secured to support structure 392 using a mechanical fastener. With fastening strip 340 of lower building surface panel 300B against support structure 392, overhang 350 of upper building surface panel 300A hangs down in front of fastening strip 340 of lower building surface panel 300B, such that overhang 350 of upper building surface panel 300A and fastening strip 340 of lower building surface panel 300B overlap. FIG. 3C shows an enlarged view of FIG. 3B to illustrate the connection between upper building surface panel 300A and lower building surface panel 300B.

As shown in FIG. 3A, panel body 320 of building surface panel 300 includes a lower projection 330 that is formed by an angled lower wall 334 of the panel body 320. Specifically, the rear wall 324 of panel body 320 extends lower than the front wall 322, such that the lower side of panel body 320 is formed by an angled lower wall 334 that faces forward and downward. This angled lower wall 334 of lower projection 330 forms the front-facing engagement surface 360 configured to engage a neighboring building surface panel. On the other hand, at the upper side 310 of building surface panel 300, fastening strip 340 includes an attachment section 342 aligned with rear attachment surface 316 and an upper projection 344 that extends upward and outward at an angle to attachment section 342. Accordingly, the rear-facing engagement surface 362 is provided on the rear side of the angled upper projection 344 and is configured to be secured against the front-facing engagement surface of a neighboring building surface panel.

For example, as shown in FIG. 3C, fastening strip 340 of lower building surface panel 300B is secured against support structure 392, thereby holding upper projection 344 of lower building surface panel 300B securely in place. Lower projection 330 of upper building surface panel 300A is positioned behind upper projection 344 of lower building surface panel 300B such that the rear-facing engagement surface 362 of lower building surface panel 300B is placed against the front-facing engagement surface 360 of the lower projection 330 of upper building surface panel 300A so as to hold the upper building surface panel 300A against support structure 392.

Figure 4A:
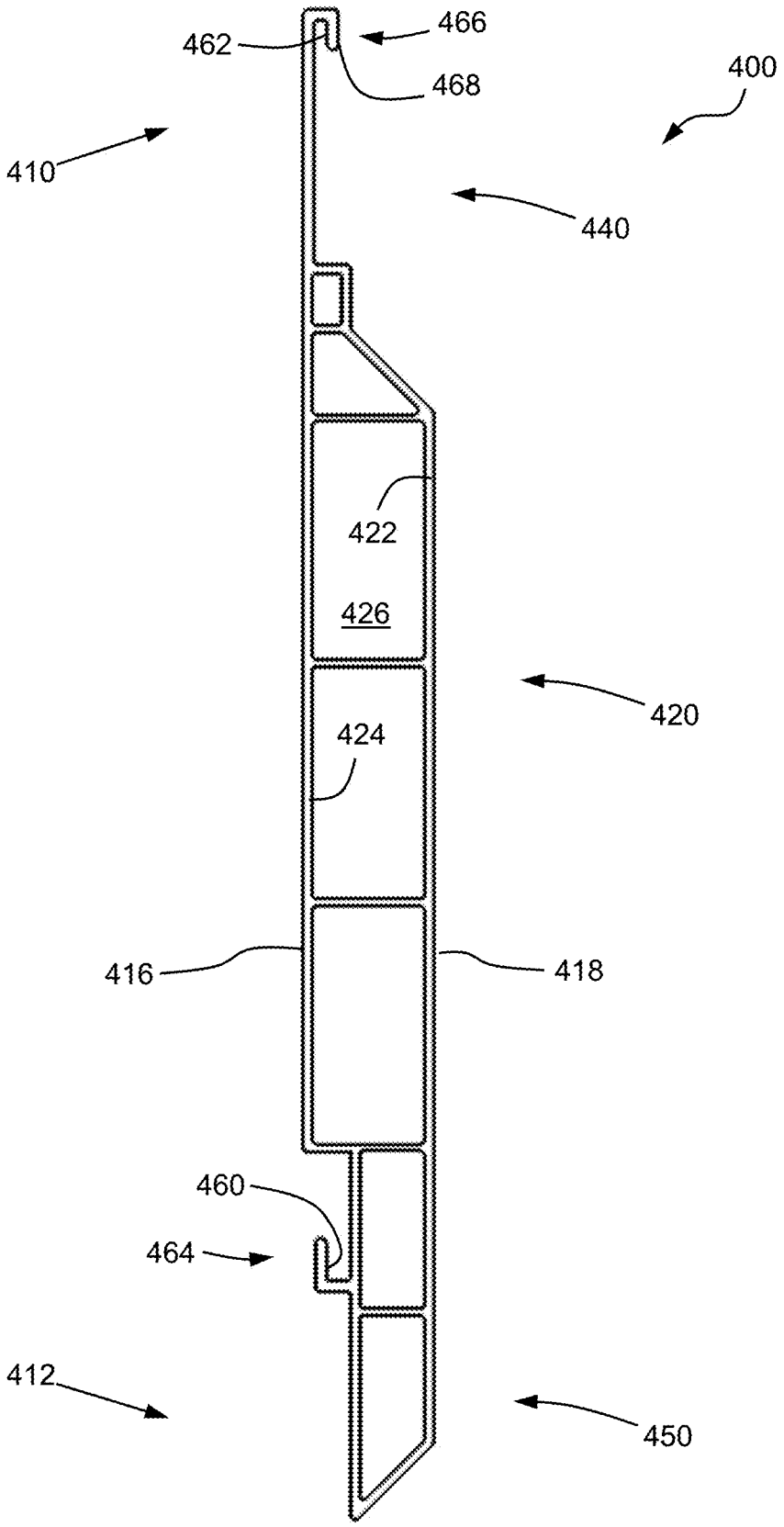
FIG. 4A is a cross-sectional view building surface panel according to an embodiment of the disclosure.
Figure 4B:
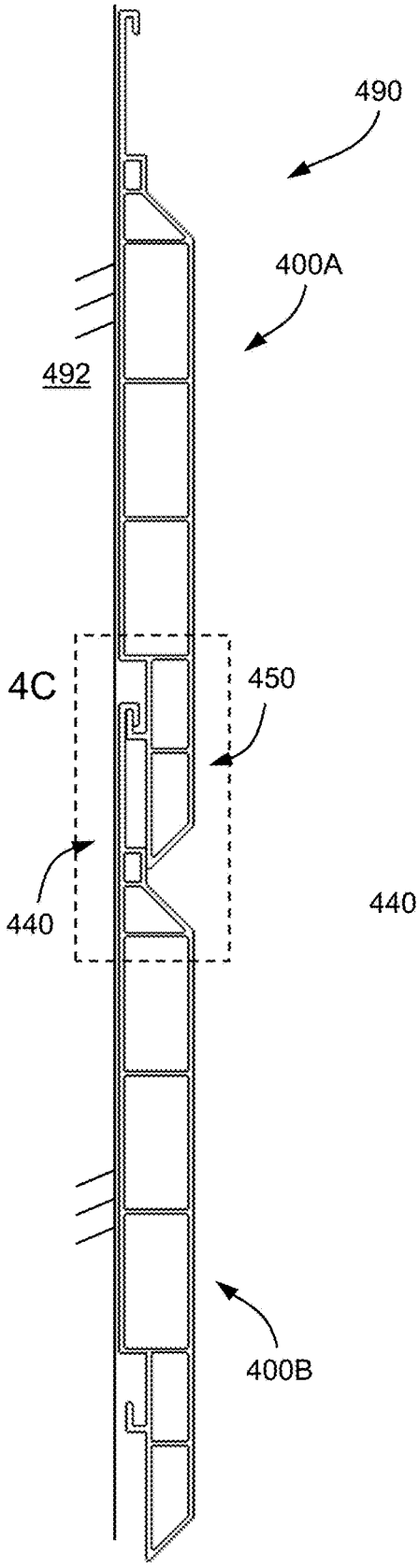
FIG. 4B is a cross-sectional view of a building surface system including a pair of building surface panels according to FIG. 4A secured to a support structure in accordance with an embodiment of the disclosure.
Figure 4C:
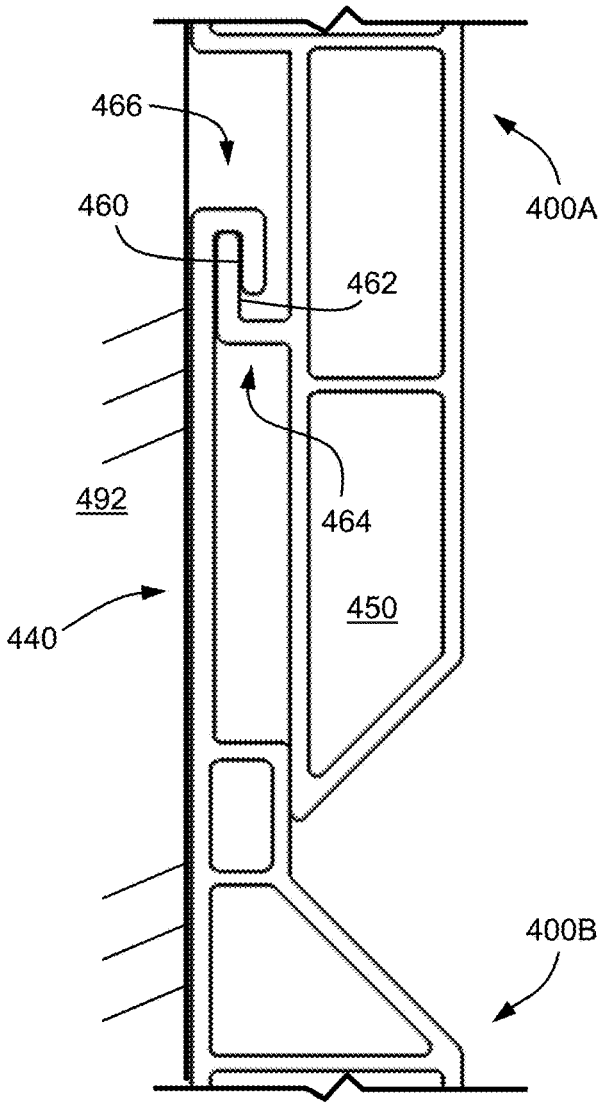
FIG. 4C is an enlarged view of a portion of FIG. 4B.

In certain embodiments of the building surface panel as otherwise described herein, the building surface panel includes a lower hook extending upward from a rear side of the overhang, and the front-facing engagement surface is formed on the lower hook. Likewise, in some embodiments, the fastening strip includes an upper hook with a downwardly extending hook end, and the rear-facing engagement surface is formed on the hook end. A building surface panel having such a construction is shown in FIGS. 4A-4C. As shown in FIG. 4A, building surface panel 400 includes a panel body 420 formed by a front wall 422 and a rear wall 424 with a hollow interior space 426 between front wall 422 and rear wall 424. A fastening strip 440 is attached to panel body 420 along the upper side 410 of building surface panel 400 and extends upward from panel body 420. Likewise, an overhang 450 is attached to panel body 420 along the lower side 412 of building surface panel 400 and extends downward from panel body 420. Rear wall 424 of panel body 420 and fastening strip 440 form a rear attachment surface 416 of building surface panel 400. On the other hand, front wall 422 of panel body 420 and overhang 450 form an exposed front surface 418 of building surface panel 400.

Fastening strip 440 and overhang 450 are configured such that adjacent building surface panels having the same construction as building surface panel 400 will overlap and connect to one another. For example, FIG. 4B shows a building surface system 490 including an upper building surface panel 400A connected to a lower building surface panel 400B, where each of upper building surface panel 400A and lower building surface panel 400B have the same construction as building surface panel 400 of FIG. 4A. As shown in FIG. 4B, fastening strip 440 of lower building surface panel 400B is placed against a support structure 492 so that it may be secured to support structure 492 using a mechanical fastener. With fastening strip 440 of lower building surface panel 400B against support structure 492, overhang 450 of upper building surface panel 400A hangs down in front of fastening strip 440 of lower building surface panel 400B, such that overhang 450 of upper building surface panel 400A and fastening strip 440 of lower building surface panel 400B overlap. FIG. 4C shows an enlarged view of FIG. 4B to illustrate the connection between upper building surface panel 400A and lower building surface panel 400B.

As shown in FIG. 4A, panel body 420 of building surface panel 400 includes a lower hook 464 extending upward from a rear side of the overhang 450. The inside surface of lower hook 464 forms the front-facing engagement surface 460 of building surface panel 400. To cooperate with such a lower hook, the fastening strip 440 at the upper side 410 of building surface panel 400 includes an upper hook 466 with a downwardly extending hook end 468. Moreover, the downwardly extending hook end 468 forms the rear-facing engagement surface 462 and is configured to be secured against the front-facing engagement surface of a lower hook of a neighboring building surface panel.

For example, as shown in FIG. 4C, fastening strip 440 of lower building surface panel 400B is secured against support structure 492, thereby holding upper hook 466 of lower building surface panel 400B securely in place. The overhang 450 of upper building surface panel 400A is then coupled to fastening strip 440 of lower building surface panel 400B by engagement of lower hook 464 on the rear surface of overhang 450 with the upper hook 466 of lower building surface panel 400B. Accordingly, the rear-facing engagement surface 462 of lower building surface panel 400B is placed against the front-facing engagement surface 460 of the lower projection 430 of upper building surface panel 400A so as to hold the upper building surface panel 400A against support structure 492.

In certain embodiments of the building surface panel as otherwise described herein, the building surface panel includes a lower flange extending downward from the overhang, and the front-facing engagement surface is formed on the lower flange. Further, in some embodiments, the panel body includes a channel, and the rear-facing engagement surface is formed in the channel.

Figure 5A:
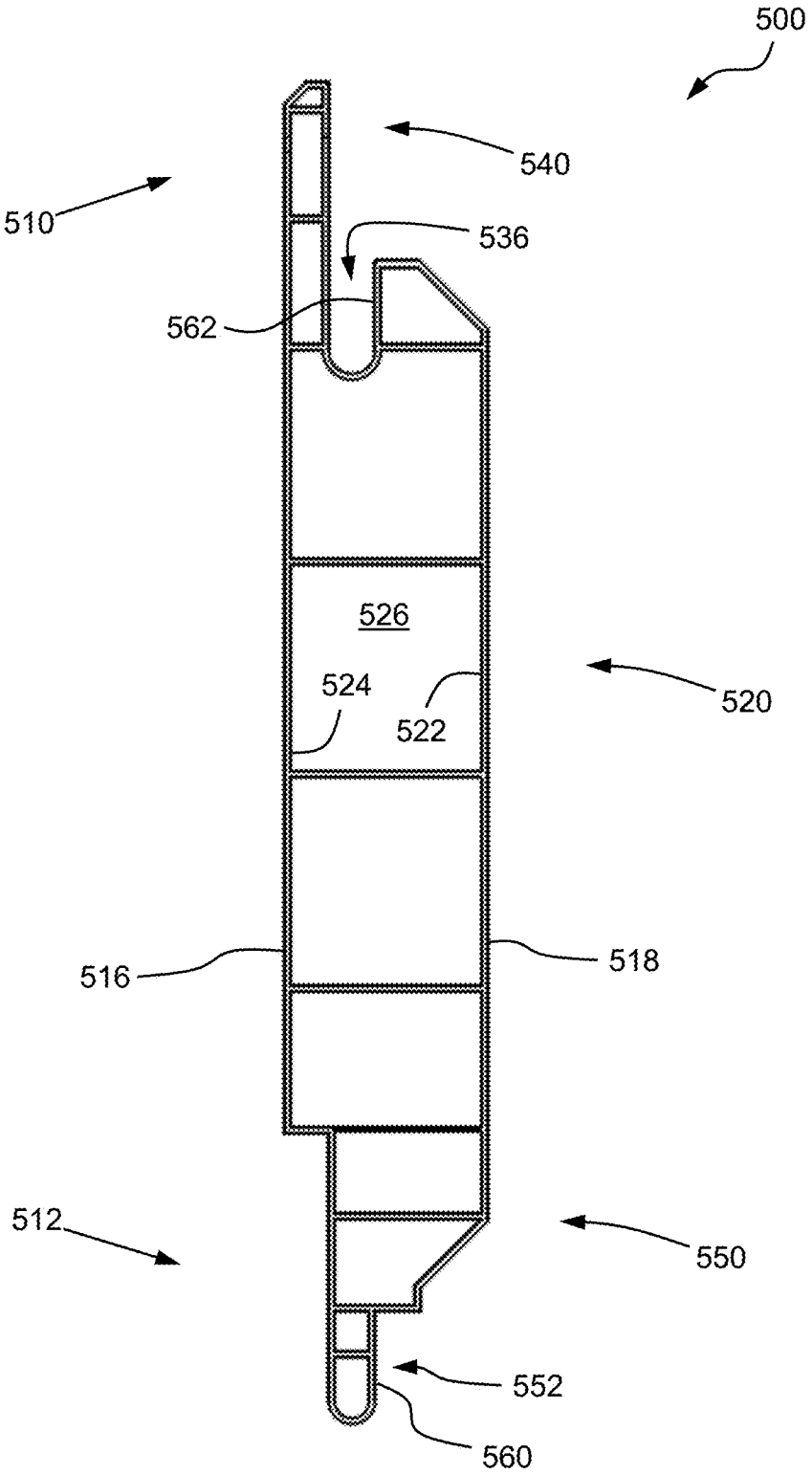
FIG. 5A is a cross-sectional view building surface panel according to an embodiment of the disclosure.
Figure 5B:
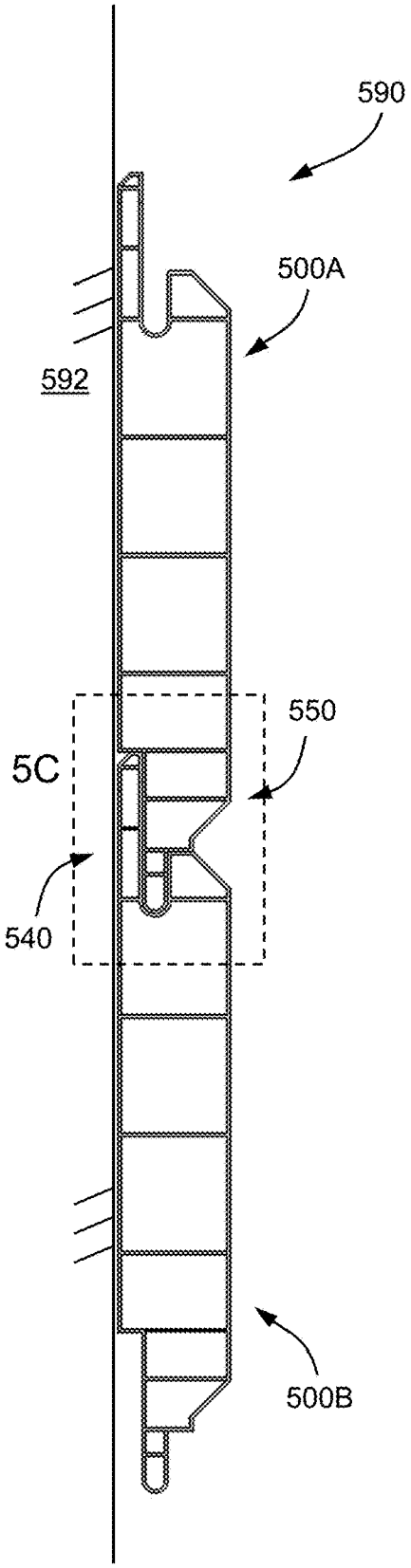
FIG. 5B is a cross-sectional view of a building surface system including a pair of building surface panels according to FIG. 5A secured to a support structure in accordance with an embodiment of the disclosure.
Figure 5C:
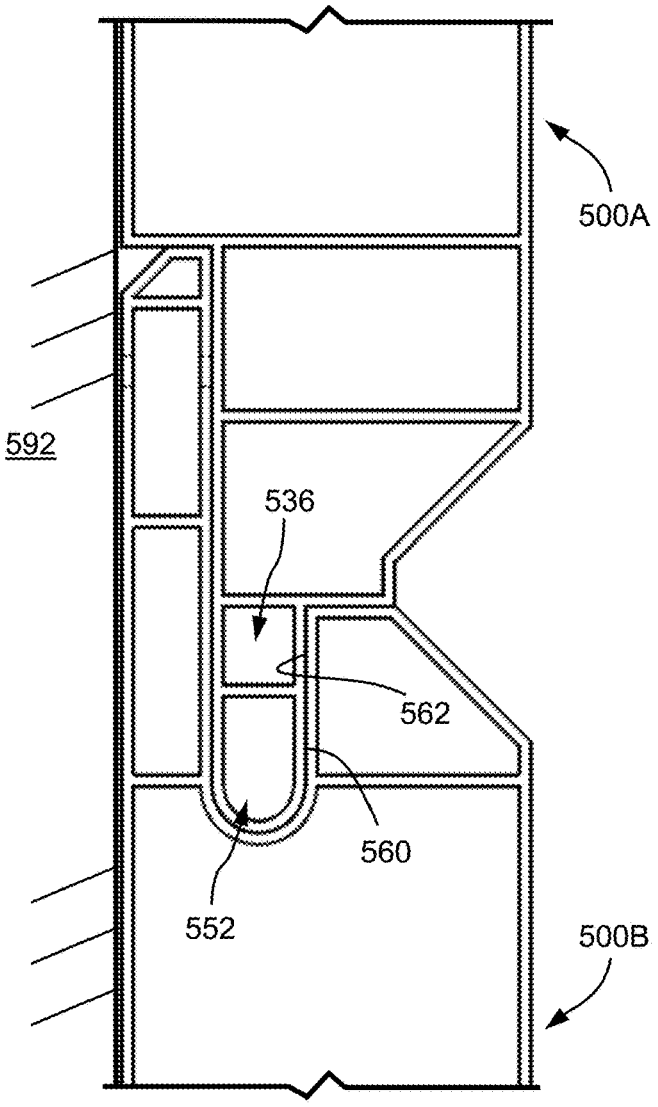
FIG. 5C is an enlarged view of a portion of FIG. 5B.

A building surface panel having such a construction is shown in FIGS. 5A-5C. As shown in FIG. 5A, building surface panel 500 includes a panel body 520 formed by a front wall 522 and a rear wall 524 with a hollow interior space 526 between front wall 522 and rear wall 524. A fastening strip 540 is attached to panel body 520 along the upper side 510 of building surface panel 500 and extends upward from panel body 520. Likewise, an overhang 550 is attached to panel body 520 along the lower side 512 of building surface panel 500 and extends downward from panel body 520. Rear wall 524 of panel body 520 and fastening strip 540 form a rear attachment surface 516 of building surface panel 500. On the other hand, front wall 522 of panel body 520 and overhang 550 form an exposed front surface 518 of building surface panel 500.

Fastening strip 540 and overhang 550 are configured such that adjacent building surface panels having the same construction as building surface panel 500 will overlap and connect to one another. For example, FIG. 5B shows a building surface system 590 including an upper building surface panel 500A connected to a lower building surface panel 500B, where each of upper building surface panel 500A and lower building surface panel 500B have the same construction as building surface panel 500 of FIG. 5A. As shown in FIG. 5B, fastening strip 540 of lower building surface panel 500B is placed against a support structure 592 so that it may be secured to support structure 592 using a mechanical fastener. With fastening strip 540 of lower building surface panel 500B against support structure 592, overhang 550 of upper building surface panel 500A hangs down in front of fastening strip 540 of lower building surface panel 500B, such that overhang 550 of upper building surface panel 500A and fastening strip 540 of lower building surface panel 500B overlap. FIG. 5C shows an enlarged view of FIG. 5B to illustrate the connection between upper building surface panel 500A and lower building surface panel 500B.

As shown in FIG. 5A, building surface panel 500 includes a lower flange 552 extending downward from overhang 550 with front-facing engagement surface 560 being disposed on the front side of lower flange 552. To cooperate with the lower flange 552 extending from the overhang 550, the upper side of panel body 520 includes a channel 536 that is configured to receive a lower flange of an upper neighboring building surface panel. Specifically, the channel 536 includes a rear-facing engagement surface 562 configured to be secured against the front-facing engagement surface of a lower flange of a neighboring building surface panel.

For example, as shown in FIG. 5C, panel body 520 of lower building surface panel 500B includes a channel 536 that receives a lower flange 552 extending from an overhang 550 of upper building surface panel 500A. Moreover, the front-facing engagement surface 560 on the lower flange 552 of the upper building surface panel 500A is secured against the rear-facing engagement surface 562 in channel 536 of panel body 520 of lower building surface panel 500B.

In certain embodiments of the building surface panel as otherwise described herein, the overhang is hollow. For example, overhang 150 of building surface panel 100, as shown in FIG. 1A, is formed by a rear wall 154 and a front wall 156 that is an extension of the front wall 122 of panel body 120. Rear wall 154 is disposed in front of rear attachment surface 116 to provide room for overlapping with the fastening strip of a neighboring building surface panel. The overhangs of building surface panels 200, 300 and 400 also each have a hollow configuration.

Figure 6A:
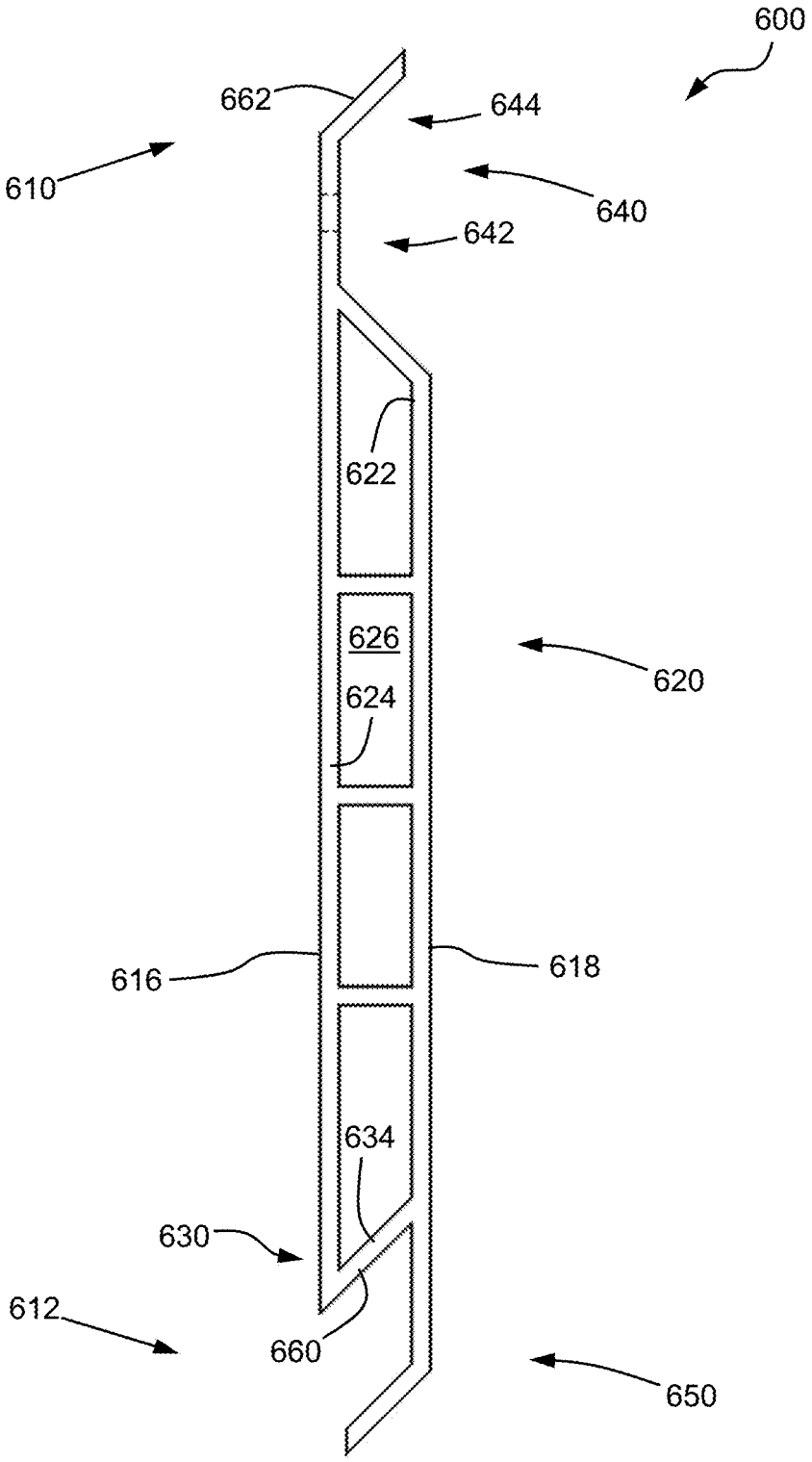
FIG. 6A is a cross-sectional view building surface panel according to an embodiment of the disclosure.
Figure 6B:
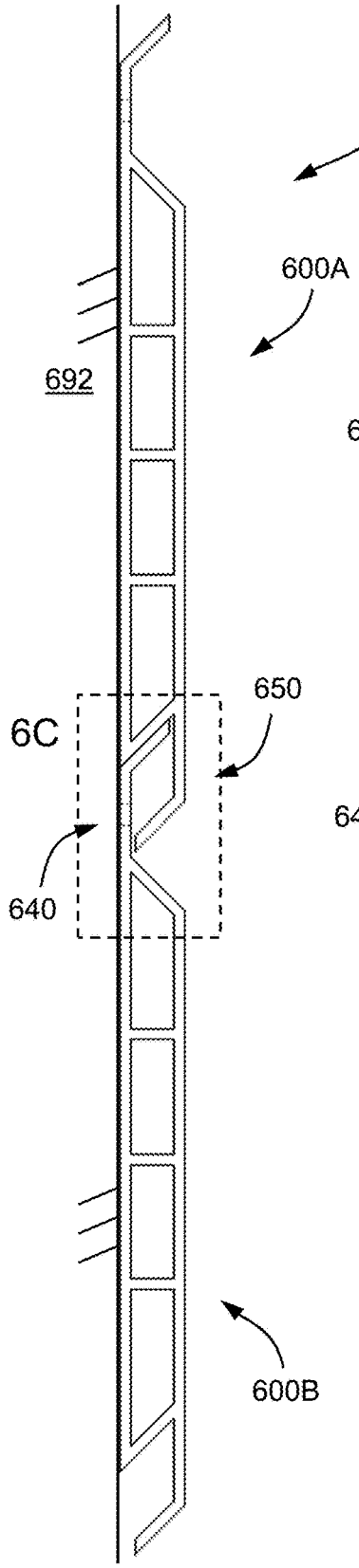
FIG. 6B is a cross-sectional view of a building surface system including a pair of building surface panels according to FIG. 6A secured to a support structure in accordance with an embodiment of the disclosure.
Figure 6C:
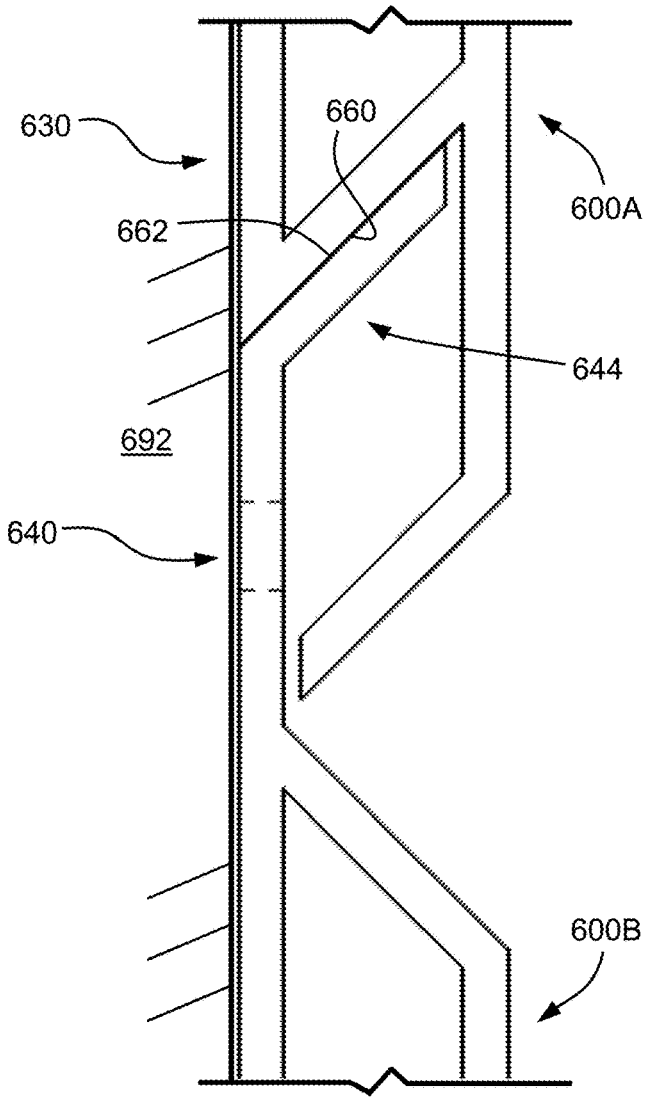
FIG. 6C is an enlarged view of a portion of FIG. 6B.

In other embodiments, the overhang is formed by a single wall. A building surface panel having such a construction is shown in FIGS. 6A-6C. As shown in FIG. 6A, building surface panel 600 includes a panel body 620 formed by a front wall 622 and a rear wall 624 with a hollow interior space 626 between front wall 622 and rear wall 624. A fastening strip 640 is attached to panel body 620 along the upper side 610 of building surface panel 600 and extends upward from panel body 620. Likewise, an overhang 650 is attached to panel body 620 along the lower side 612 of building surface panel 600 and extends downward from panel body 620. The overhang 650 is formed by a single wall that is an extension of front wall 622 of panel body 620. Rear wall 624 of panel body 620 and fastening strip 640 form a rear attachment surface 616 of building surface panel 600. On the other hand, front wall 622 of panel body 620 and the single wall of overhang 650 form an exposed front surface 618 of building surface panel 600.

Fastening strip 640 and overhang 650 are configured such that adjacent building surface panels having the same construction as building surface panel 600 will overlap and connect to one another. For example, FIG. 6B shows a building surface system 690 including an upper building surface panel 600A connected to a lower building surface panel 600B, where each of upper building surface panel 600A and lower building surface panel 600B have the same construction as building surface panel 600 of FIG. 6A. As shown in FIG. 6B, fastening strip 640 of lower building surface panel 600B is placed against a support structure 692 so that it may be secured to support structure 692 using a mechanical fastener. With fastening strip 640 of lower building surface panel 600B against support structure 692, overhang 650 of upper building surface panel 600A hangs down in front of fastening strip 640 of lower building surface panel 600B, such that overhang 650 of upper building surface panel 600A and fastening strip 640 of lower building surface panel 600B overlap. FIG. 6C shows an enlarged view of FIG. 6B to illustrate the connection between upper building surface panel 600A and lower building surface panel 600B.

As shown in FIG. 6A, panel body 620 of building surface panel 600 includes a lower projection 630 that is formed by an angled lower wall 634 of the panel body 620. Specifically, the rear wall 624 of panel body 620 extends lower than the front wall 622, such that the lower side of panel body 620 is formed by an angled lower wall 634 that faces forward and downward. This angled lower wall 634 of lower projection 630 forms the front-facing engagement surface 660 configured to engage a neighboring building surface panel. On the other hand, at the upper side 610 of building surface panel 600, fastening strip 640 includes an attachment section 642 aligned with rear attachment surface 616 and an upper projection 644 that extends upward and outward at an angle to attachment section 642. Accordingly, the rear-facing engagement surface 662 is provided on the rear side of the angled upper projection 644 and is configured to be secured against the front-facing engagement surface of a neighboring building surface panel.

For example, as shown in FIG. 6C, fastening strip 640 of lower building surface panel 600B is secured against support structure 692, thereby holding upper projection 644 of lower building surface panel 600B securely in place. Lower projection 630 of upper building surface panel 600A is positioned behind upper projection 644 of lower building surface panel 600B such that the rear-facing engagement surface 662 of lower building surface panel 600B is placed against the front-facing engagement surface 660 of the lower projection 630 of upper building surface panel 600A so as to hold the upper building surface panel 600A against support structure 692.

In certain embodiments of the building surface panel as otherwise described herein, the fastening strip is formed by a single wall. For example, in building surface panel 100, fastening strip 140 is formed by a single wall. In other embodiments, the fastening strip is hollow. For example, in building surface panel 300, fastening strip 340 has a hollow construction with front and rear walls that enclose an interior space. The fastening strip 340 maybe configured to receive a fastener that extends through both walls of the hollow construction. The use of a hollow fastening strip may provide a sturdy construction for both the attachment section 342 and the upper projection 344. Likewise, the hollow construction of the fastening strip may help prevent any fasteners extending therethrough from being inserted too far. Specifically, any over insertion of the fastener against the hollow fastening strip 340 may begin to crush the fastening strip, thereby indicating that the fastener has been inserted too far.

Figure 7A:
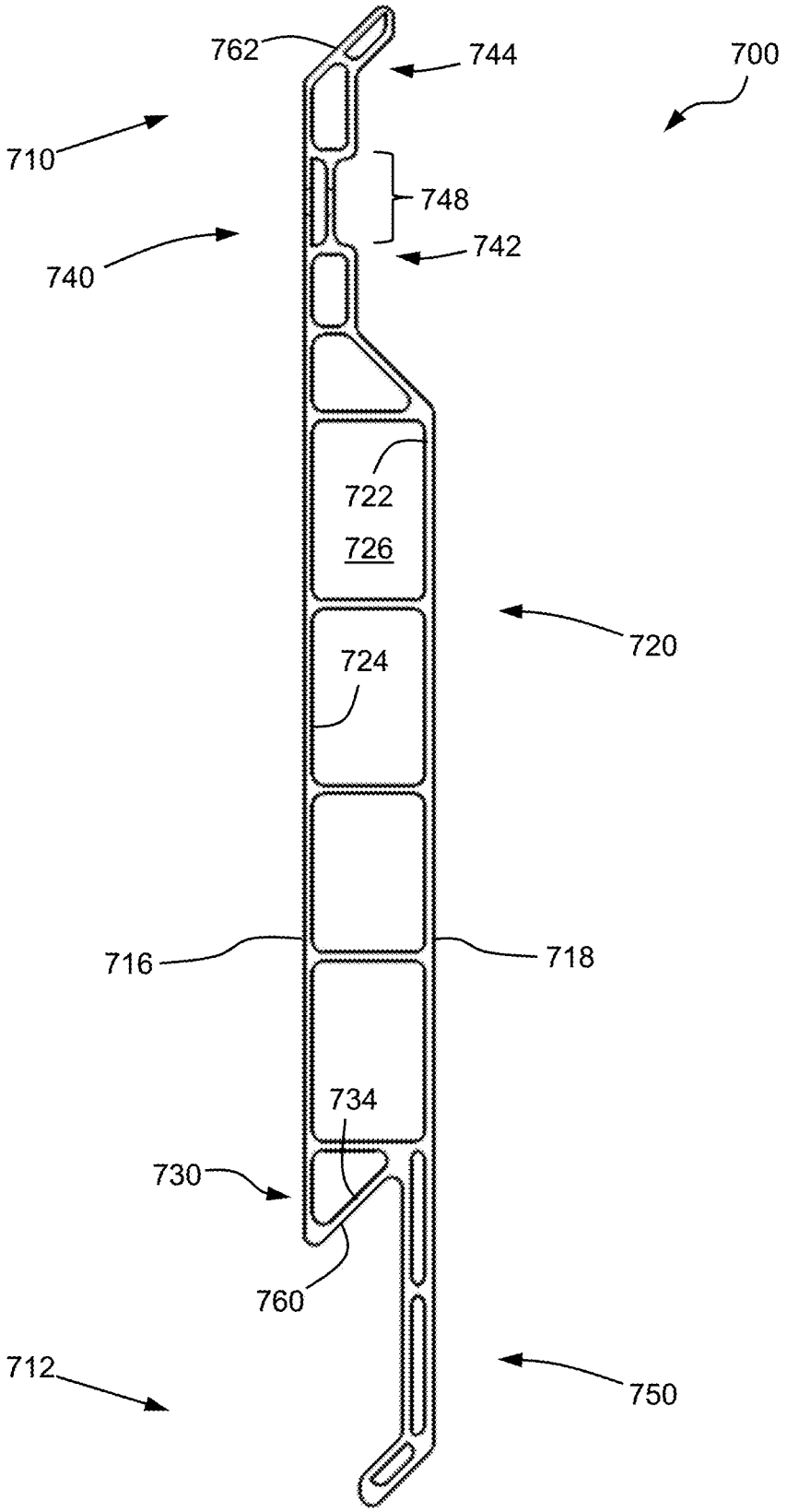
FIG. 7A is a cross-sectional view building surface panel according to an embodiment of the disclosure.
Figure 7B:
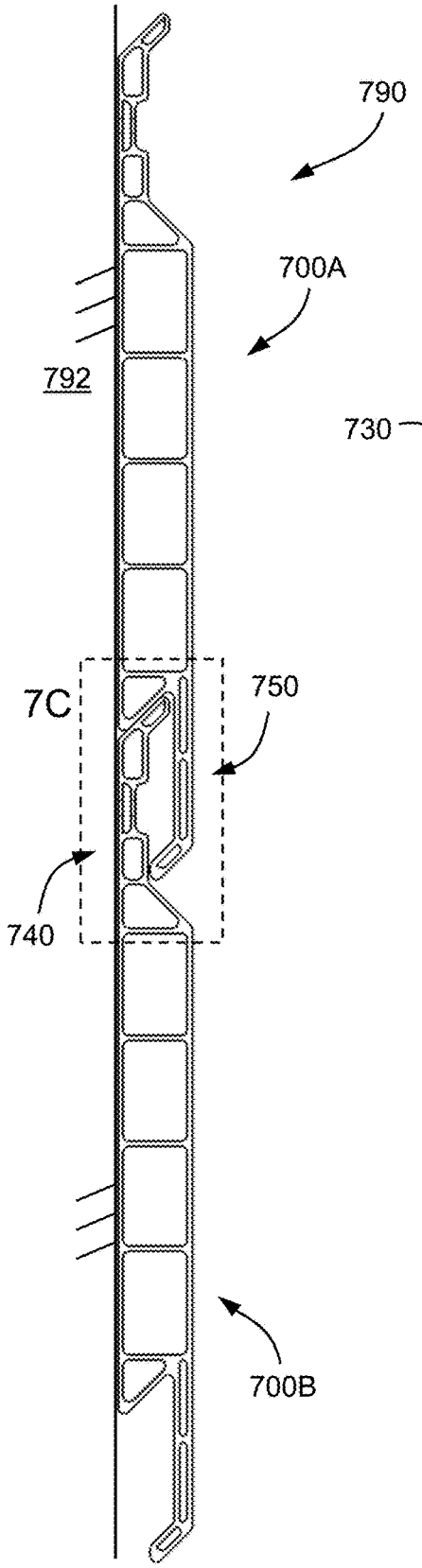
FIG. 7B is a cross-sectional view of a building surface system including a pair of building surface panels according to FIG. 7A secured to a support structure in accordance with an embodiment of the disclosure.
Figure 7C:
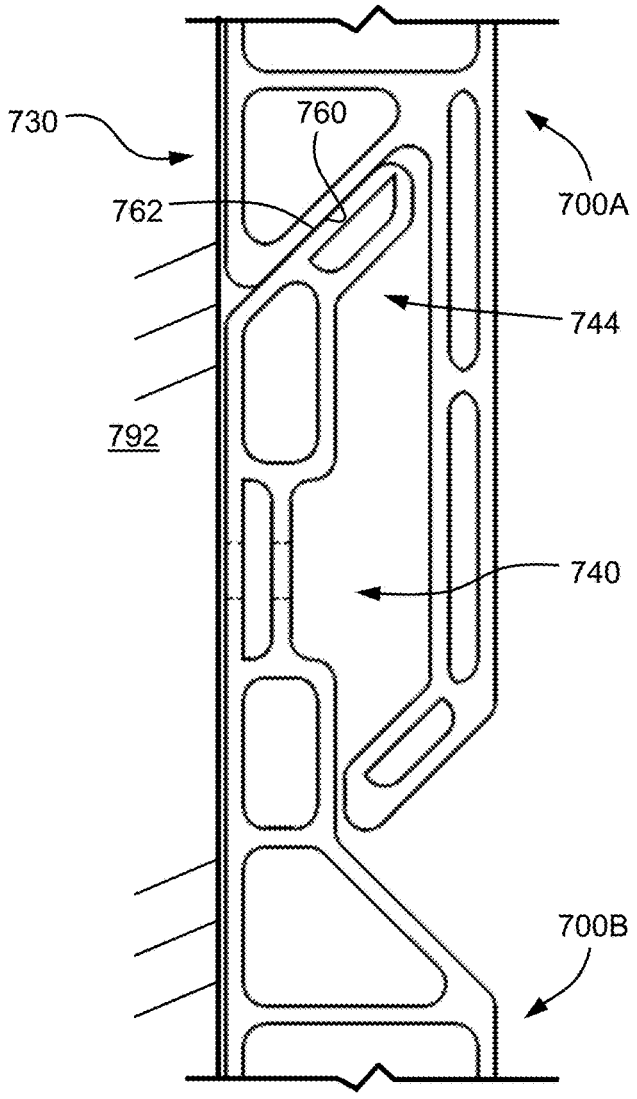
FIG. 7C is an enlarged view of a portion of FIG. 7B.

In certain embodiments of the building surface panel as otherwise described herein, the fastening strip includes a channel configured to receive a fastener for securing the building surface panel to a support structure. Such a building surface panel is shown in FIGS. 7A-7C. As shown in FIG. 7A, building surface panel 700 includes a panel body 720 formed by a front wall 722 and a rear wall 724 with a hollow interior space 726 between front wall 722 and rear wall 724. A hollow fastening strip 740 is attached to panel body 720 along the upper side 710 of building surface panel 700 and extends upward from panel body 720. Likewise, an overhang 750 is attached to panel body 720 along the lower side 712 of building surface panel 700 and extends downward from panel body 720. Rear wall 724 of panel body 720 and fastening strip 740 form a rear attachment surface 716 of building surface panel 700. On the other hand, front wall 722 of panel body 720 and overhang 750 form an exposed front surface 718 of building surface panel 700.

Fastening strip 740 and overhang 750 are configured such that adjacent building surface panels having the same construction as building surface panel 700 will overlap and connect to one another. For example, FIG. 7B shows a building surface system 790 including an upper building surface panel 700A connected to a lower building surface panel 700B, where each of upper building surface panel 700A and lower building surface panel 700B have the same construction as building surface panel 700 of FIG. 7A. As shown in FIG. 7B, fastening strip 740 of lower building surface panel 700B is placed against a support structure 792 so that it may be secured to support structure 792 using a mechanical fastener. With fastening strip 740 of lower building surface panel 700B against support structure 792, overhang 750 of upper building surface panel 700A hangs down in front of fastening strip 740 of lower building surface panel 700B, such that overhang 750 of upper building surface panel 700A and fastening strip 740 of lower building surface panel 700B overlap. FIG. 7C shows an enlarged view of FIG. 7B to illustrate the connection between upper building surface panel 700A and lower building surface panel 700B.

As shown in FIG. 7A, panel body 720 of building surface panel 700 includes a lower projection 730 that is formed by an angled lower wall 734 of the panel body 720. Specifically, the rear wall 724 of panel body 720 extends lower than the front wall 722, such that the lower side of panel body 720 is formed by an angled lower wall 734 that faces forward and downward. This angled lower wall 734 of lower projection 730 forms the front-facing engagement surface 760 configured to engage a neighboring building surface panel. On the other hand, at the upper side 710 of building surface panel 700, fastening strip 740 includes an attachment section 742 aligned with rear attachment surface 716 and an upper projection 744 that extends upward and outward at an angle to attachment section 742. Accordingly, the rear-facing engagement surface 762 is provided on the rear side of the angled upper projection 744 and is configured to be secured against the front-facing engagement surface of a neighboring building surface panel.

For example, as shown in FIG. 7C, fastening strip 740 of lower building surface panel 700B is secured against support structure 792, thereby holding upper projection 744 of lower building surface panel 700B securely in place. Lower projection 730 of upper building surface panel 700A is positioned behind upper projection 744 of lower building surface panel 700B such that the rear-facing engagement surface 762 of lower building surface panel 700B is placed against the front-facing engagement surface 760 of the lower projection 730 of upper building surface panel 700A so as to hold the upper building surface panel 700A against support structure 792.

The front wall of fastening strip 740 includes a channel 748 configured to receive a fastener for securing building surface panel 700 against the support structure 792. The channel 748 may be sized to receive the head of a fastener, but to prevent a tool, such as a hammer, from overdriving the fastener into the support structure 792.

In certain embodiments of the building surface panel as otherwise described herein, the upper projection is configured to vertically support an upper neighboring building surface panel. In the configuration of building surface panel 100, vertical support is provided at both the top of upper projection 144 and at the bottom of lower projection 130. Specifically, the top of upper projection 144 of lower building surface panel 100B supports the panel body 120 of upper building surface panel 100A. At the same time, the bottom of lower projection 130 of upper building surface panel 100A is supported by the bend 146 at the bottom of upper projection 144. However, in other embodiments, the upper building surface panel may be supported in only one of these areas. For example, the upper projection may be shorter, such that the top of the upper projection does not reach or support the panel body. Alternatively, the lower projection 130 may be shorter, such that it does not reach and is not supported by the bend in the upper projection.

In other embodiments, the lower building surface panel may support the upper building surface panel in another location. For example, in certain embodiments of the building surface panel as otherwise described herein, the panel body engages an overhang of an upper neighboring building surface panel so as to provide vertical support to the upper neighboring building surface panel.

Figure 8A:
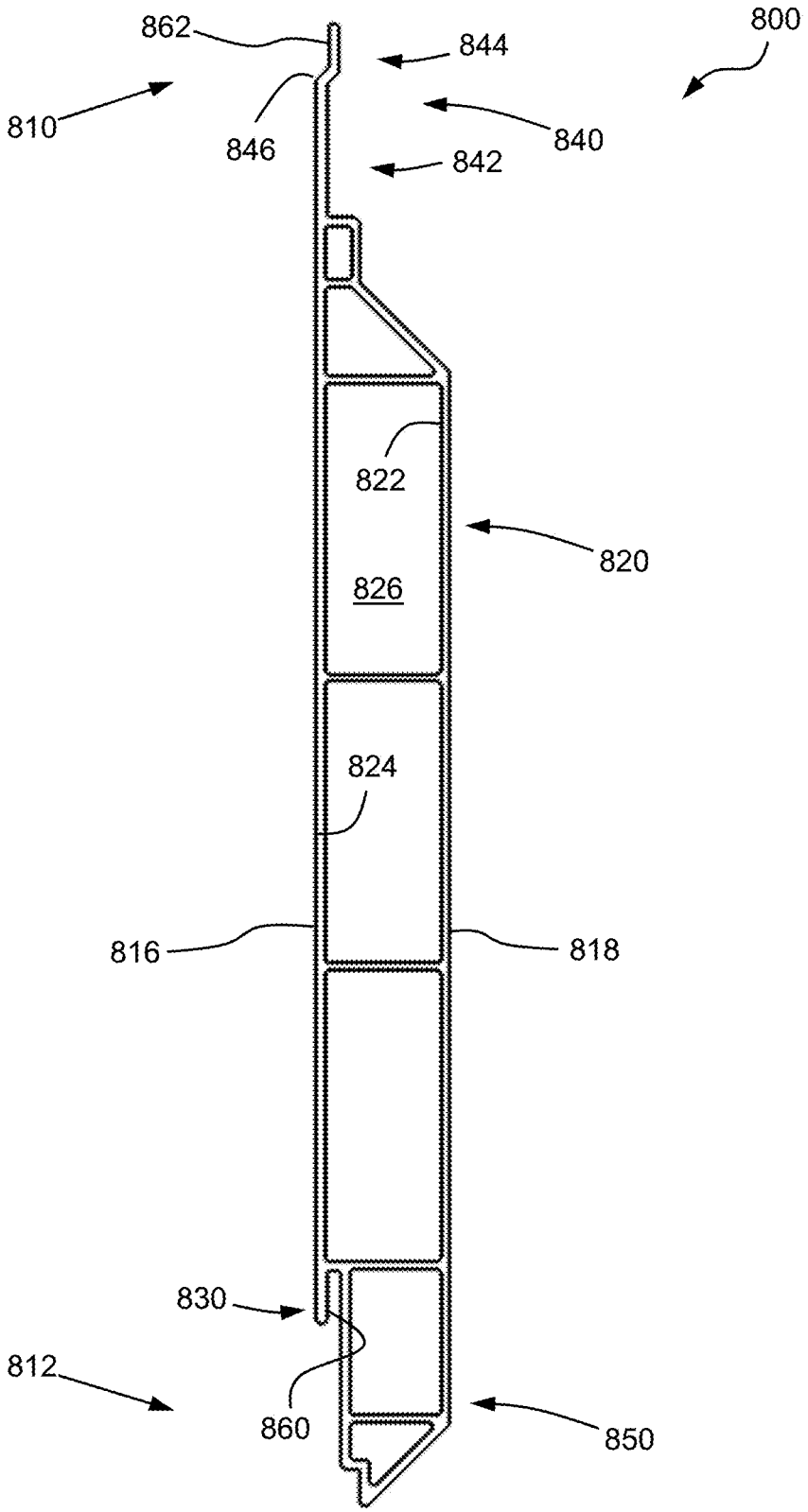
FIG. 8A is a cross-sectional view building surface panel according to an embodiment of the disclosure.

Building surface panels having such a construction are shown in FIGS. 8A-8C and 9A-9C. As shown in FIG. 8A, building surface panel 800 includes a panel body 820 formed by a front wall 822 and a rear wall 824 with a hollow interior space 826 between front wall 822 and rear wall 824. A fastening strip 840 is attached to panel body 820 along the upper side 810 of building surface panel 800 and extends upward from panel body 820. Likewise, an overhang 850 is attached to panel body 820 along the lower side 812 of building surface panel 800 and extends downward from panel body 820. Rear wall 824 of panel body 820 and fastening strip 840 form a rear attachment surface 816 of building surface panel 800. On the other hand, front wall 822 of panel body 820 and overhang 850 form an exposed front surface 818 of building surface panel 800.

Figure 8B:
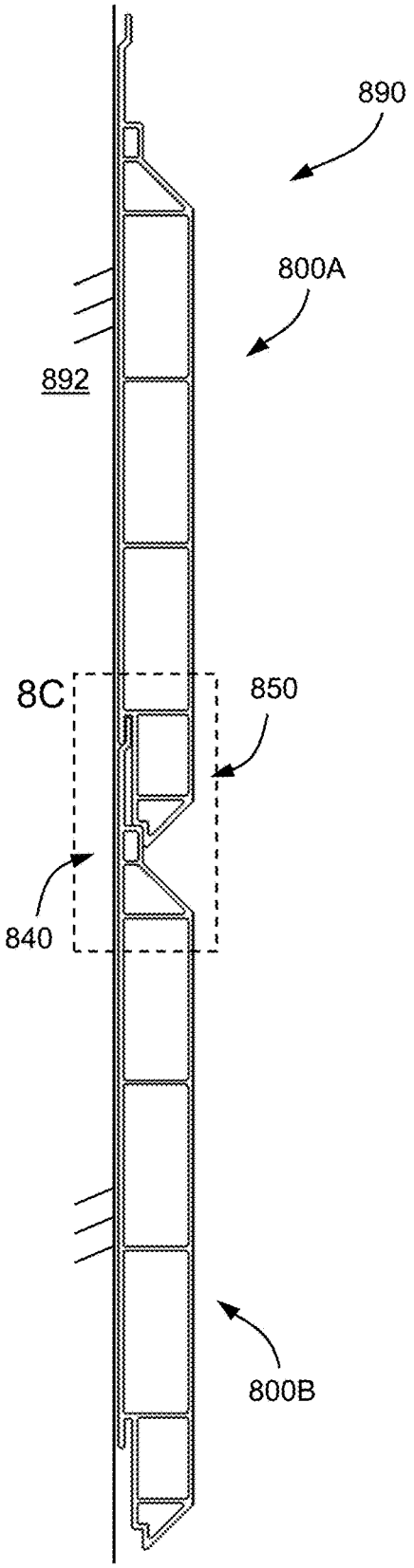
FIG. 8B is a cross-sectional view of a building surface system including a pair of building surface panels according to FIG. 8A secured to a support structure in accordance with an embodiment of the disclosure.
Figure 8C:
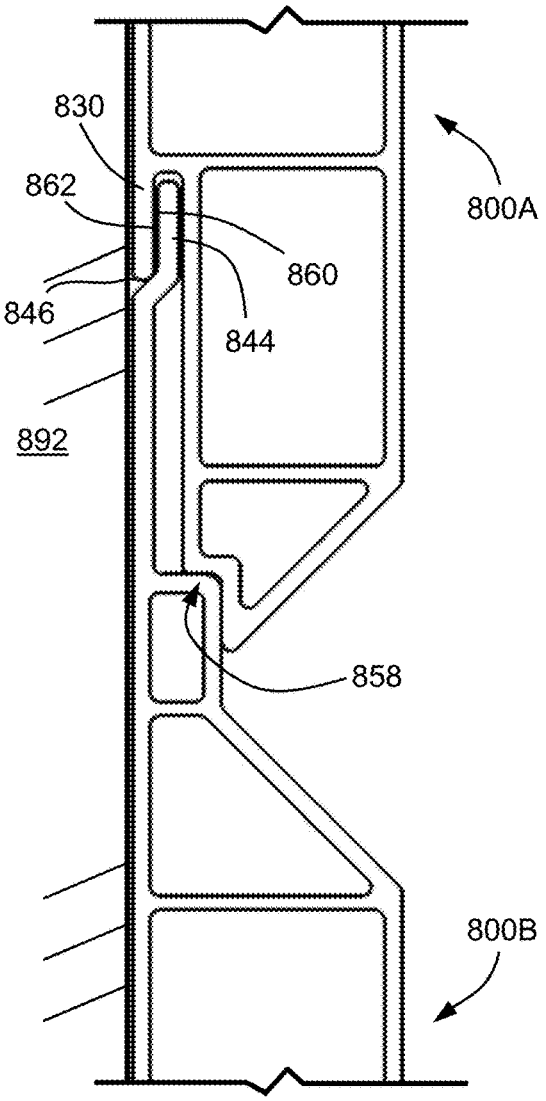
FIG. 8C is an enlarged view of a portion of FIG. 8B.

Fastening strip 840 and overhang 850 are configured such that adjacent building surface panels having the same construction as building surface panel 800 will overlap and connect to one another. For example, FIG. 8B shows a building surface system 890 including an upper building surface panel 800A connected to a lower building surface panel 800B, where each of upper building surface panel 800A and lower building surface panel 800B have the same construction as building surface panel 800 of FIG. 8A. As shown in FIG. 8B, fastening strip 840 of lower building surface panel 800B is placed against a support structure 892 so that it may be secured to support structure 892 using a mechanical fastener. With fastening strip 840 of lower building surface panel 800B against support structure 892, overhang 850 of upper building surface panel 800A hangs down in front of fastening strip 840 of lower building surface panel 800B, such that overhang 850 of upper building surface panel 800A and fastening strip 840 of lower building surface panel 800B overlap. FIG. 8C shows an enlarged view of FIG. 8B to illustrate the connection between upper building surface panel 800A and lower building surface panel 800B.

As shown in FIG. 8A, panel body 820 of building surface panel 800 includes a lower projection 830 in the form a flange that extends downward along the rear attachment surface 816. The flange forming lower projection 830 is an extension of rear wall 824 of panel body 820. At the upper side 810 of building surface panel 800, fastening strip 840 includes an upper projection 844 that extends vertically upward from an attachment section 842 of the fastening strip 840. Upper projection 844 includes a rear-facing engagement surface 862 that is configured to be secured against the front-facing engagement surface of a neighboring building surface panel.

For example, as shown in FIG. 8C, fastening strip 840 of lower building surface panel 800B is secured against support structure 892, thereby holding upper projection 844 of lower building surface panel 800B securely in place. Lower projection 830 of upper building surface panel 800A is positioned behind upper projection 844 of lower building surface panel 800B such that the rear-facing engagement surface 862 of lower building surface panel 800B is placed against the front-facing engagement surface 860 of the lower projection 830 of upper building surface panel 800A so as to hold the upper building surface panel 800A against support structure 892.

In order to vertically support the building surface panel 800, overhang 850 includes a ledge 858 that is configured to rest on the panel body of a lower neighboring building surface panel. For example, as shown in FIG. 8C, the ledge 858 of overhang 850 of upper building surface panel 800A rests on panel body 820 of lower building surface panel 800B.

Figure 9A:
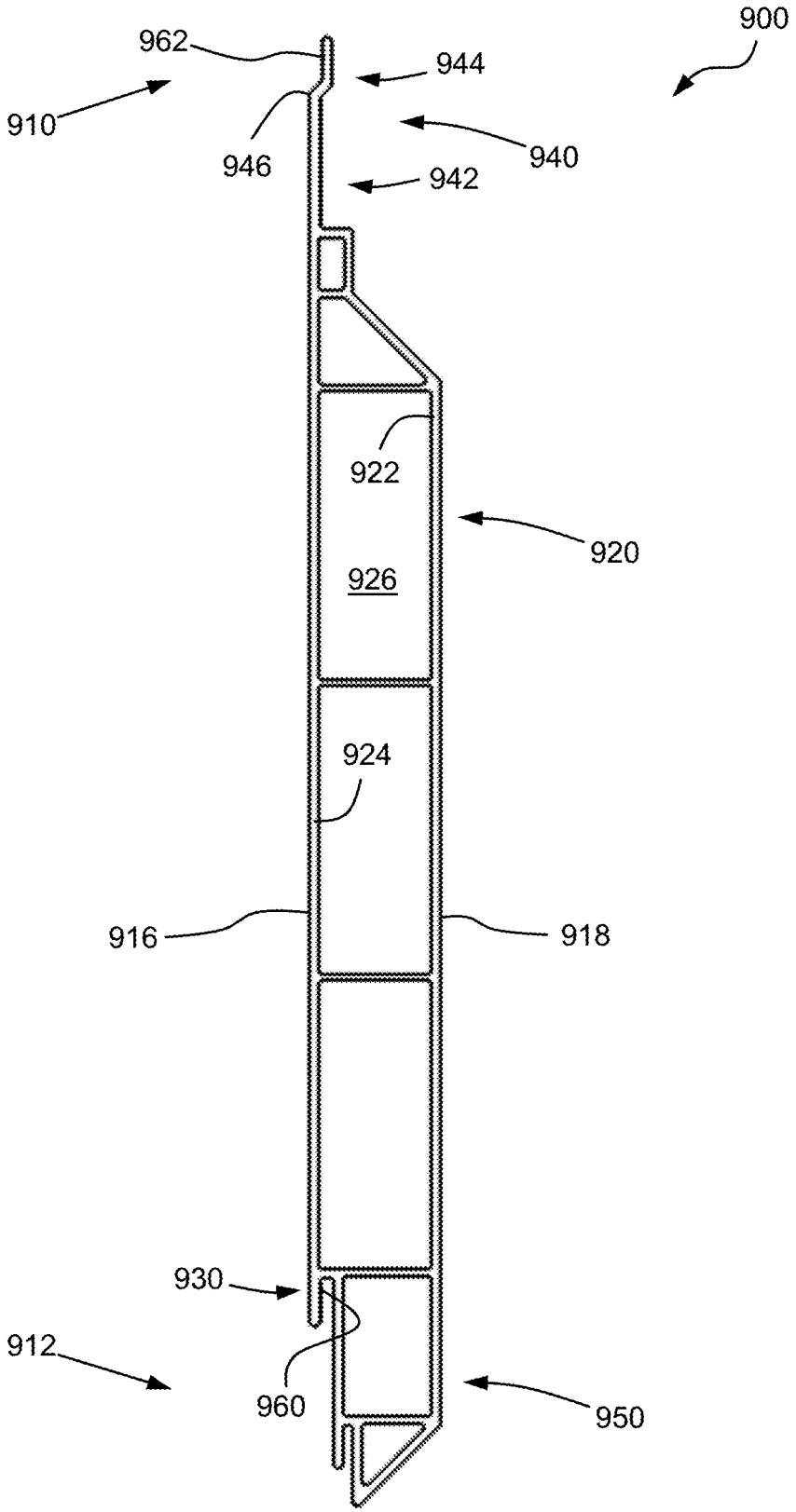
FIG. 9A is a cross-sectional view building surface panel according to an embodiment of the disclosure.
Figure 9B:
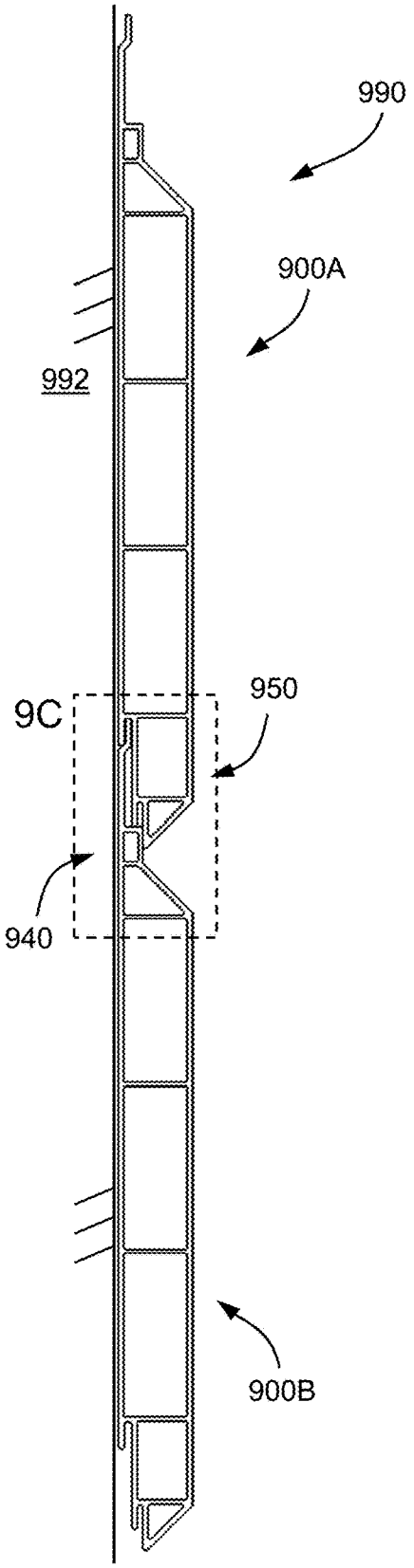
FIG. 9B is a cross-sectional view of a building surface system including a pair of building surface panels according to FIG. 9A secured to a support structure in accordance with an embodiment of the disclosure.
Figure 9C:
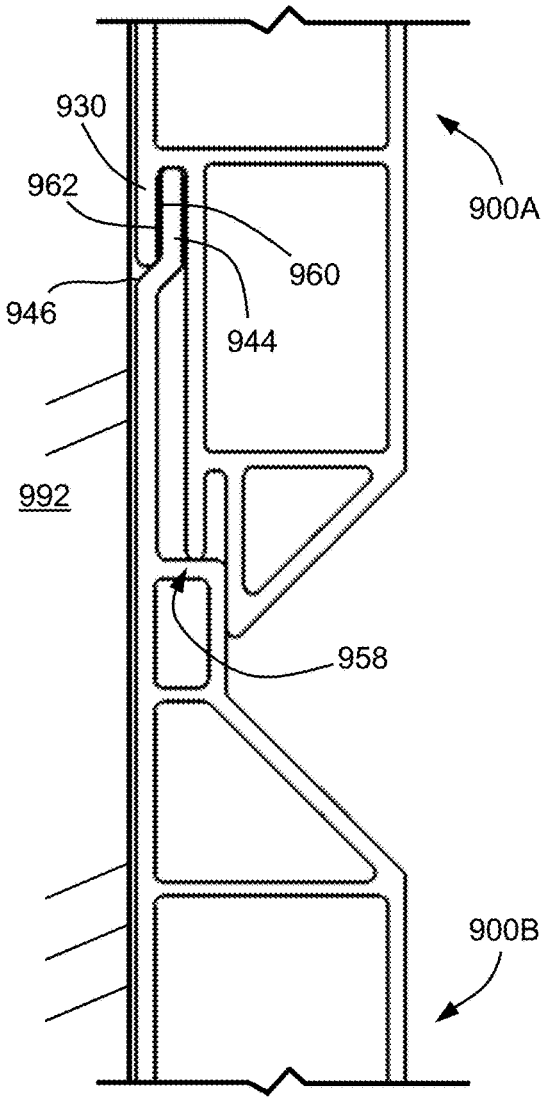
FIG. 9C is an enlarged view of a portion of FIG. 9B.

Building surface panel 900, shown in FIGS. 9A-9C has a similar construction to building surface panel 800 and includes a panel body 920 formed by a front wall 922 and a rear wall 924 with a hollow interior space 926 between front wall 922 and rear wall 924. A fastening strip 940 is attached to panel body 920 along the upper side 910 of building surface panel 900 and extends upward from panel body 920. Likewise, an overhang 950 is attached to panel body 920 along the lower side 912 of building surface panel 900 and extends downward from panel body 920. Rear wall 924 of panel body 920 and fastening strip 940 form a rear attachment surface 916 of building surface panel 900. On the other hand, front wall 922 of panel body 920 and overhang 950 form an exposed front surface 918 of building surface panel 900.

Fastening strip 940 and overhang 950 are configured such that adjacent building surface panels having the same construction as building surface panel 900 will overlap and connect to one another. For example, FIG. 9B shows a building surface system 990 including an upper building surface panel 900A connected to a lower building surface panel 900B, where each of upper building surface panel 900A and lower building surface panel 900B have the same construction as building surface panel 900 of FIG. 9A. As shown in FIG. 9B, fastening strip 940 of lower building surface panel 900B is placed against a support structure 992 so that it may be secured to support structure 992 using a mechanical fastener. With fastening strip 940 of lower building surface panel 900B against support structure 992, overhang 950 of upper building surface panel 900A hangs down in front of fastening strip 940 of lower building surface panel 900B, such that overhang 950 of upper building surface panel 900A and fastening strip 940 of lower building surface panel 900B overlap. FIG. 9C shows an enlarged view of FIG. 9B to illustrate the connection between upper building surface panel 900A and lower building surface panel 900B.

As shown in FIG. 9A, panel body 920 of building surface panel 900 includes a lower projection 930 in the form a flange that extends downward along the rear attachment surface 916. The flange forming lower projection 930 is an extension of rear wall 924 of panel body 920. At the upper side 910 of building surface panel 900, fastening strip 940 includes an upper projection 944 that extends vertically upward from an attachment section 942 of the fastening strip 940. Upper projection 944 includes a rear-facing engagement surface 962 that is configured to be secured against the front-facing engagement surface of a neighboring building surface panel.

For example, as shown in FIG. 9C, fastening strip 940 of lower building surface panel 900B is secured against support structure 992, thereby holding upper projection 944 of lower building surface panel 900B securely in place. Lower projection 930 of upper building surface panel 900A is positioned behind upper projection 944 of lower building surface panel 900B such that the rear-facing engagement surface 962 of lower building surface panel 900B is placed against the front-facing engagement surface 960 of the lower projection 930 of upper building surface panel 900A so as to hold the upper building surface panel 900A against support structure 992.

In order to vertically support the building surface panel 900, overhang 950 includes a leg 958 that is configured to rest on the panel body of a lower neighboring building surface panel. For example, as shown in FIG. 9C, the leg 958 of overhang 950 of upper building surface panel 900A rests on panel body 920 of lower building surface panel 900B.

Still, in other embodiments, the building surface panel is not configured to provide vertical support for a neighboring upper building surface panel. For example, building surface panel 400 does not provide any vertical support to an upper neighboring building surface panel. Therefore, in order to support building surface panel 400, the panel may be held in place until it is secured using a fastener.

In certain embodiments of the building surface panel as otherwise described herein, an upper side of the panel body includes a first angled surface and the lower side of the overhang includes a second angled surface so as to form a V-groove between the building surface panel and the lower neighboring building surface panel having a similar configuration. For example, building surface panel 100 includes a lower angled groove face 172 at the bottom of overhang 150 and an upper angled groove face 174 at the top of panel body 120. Accordingly, as shown in FIG. 1C, upper building surface panel 100A and lower building surface panel 100B for a V-groove 170 at the junction between the panels. In some embodiments, the lower angled groove face and the upper angled groove face have opposite angles so as to form a symmetrical V-groove. In other embodiments, these faces have different angles. Still, in other embodiments, the junction between the panels may have another configuration, such as a butt joint, or U-shaped groove.

In certain embodiments of the building surface panel as otherwise described herein, the building surface panel is a siding panel. For example, building surface panel 100 is a siding panel that is configured to interlock with other siding panels, as set forth below, and cover the exterior surface of a house or other building. In other embodiments the building surface panel is a siding accessory, such as a siding trim panel. In other embodiments, the building surface panel is another building product, such as soffit or a roofing panel. Other types of panels are also possible.

In certain embodiments of the method as otherwise described herein, the building surface panel is formed of a polymer material. For example, in some embodiments the outer shell is formed of a material including a polymer matrix that characterizes the performance of the outer shell and is mixed with one or more other components, such as fillers, reinforcing fibers, or additives.

In certain embodiments of the method as otherwise described herein, the polymer material includes polyvinyl chloride (PVC). In other embodiments the polymer material includes polypropylene, polyethylene, acrylonitrile styrene acrylate (ASA), polyurethane, or acrylonitrile butadiene styrene (ABS). Still, in other embodiments, the outer shell is formed of another material, such as metal, cement or natural products like wood or bamboo.

In certain embodiments of the building surface panel as otherwise described herein, the fastening strip includes a slot configured to receive a fastener for securing the building surface panel to a support structure. For example, as shown in FIG. 1D, fastening strip 140 includes slotted apertures 145 positioned in a row along the length 102 of building surface panel 100. As shown in FIG. 1E, when building surface panel 100 is secured to a support structure, one or more mechanical fasteners 196 may be inserted through the slotted apertures 145 to hold the building surface panel 100 against the support structure 192.

In some embodiments, the mechanical fastener is a nail. In other embodiments, the mechanical fastener may take another form, such as a screw, a staple or a tack. In other embodiments, the fastening strip is used to secure the siding panel to a support structure using an adhesive or another method. Further, while in some embodiments mechanical fasteners are used alone to secure the fastening strip to the support structure, in other embodiments, a mechanical fastener is used in conjunction with an adhesive over other material to secure the fastening strip to the support structure.

In certain embodiments of the building surface panel as otherwise described herein, a length of the building surface panel is at least 4 feet, e.g., at least 6 feet, e.g., at least 8 feet. Further, in some embodiments, a length of the building surface panel is no more than 30 feet, e.g., no more than 24 feet, e.g., no more than 18 feet. For example, in some embodiments, the length of the building surface panel is in a range from 4 feet to 30 feet, e.g., from 6 feet to 24 feet, e.g., from 8 feet to 18 feet.

In certain embodiments of the building surface panel as otherwise described herein, a width of the building surface panel is at least 4 inches, e.g. at least 6 inches, e.g., at least 8 inches, e.g., at least 10 inches. Further, in some embodiments, a width of the building surface panel is no more than 3 feet, e.g., no more than 2 feet, e.g., no more than 18 inches. For example, in some embodiments, the width of the building surface panel is in a range from 4 inches to 3 feet, e.g., from 6 inches to 2 feet, e.g., from 8 inches to 18 inches.

In certain embodiments of the building surface panel as otherwise described herein, a thickness of the building surface panel is at least ½ inch, e.g., at least ⅝ inch, e.g., at least ¾ inch. In some embodiments, a thickness of the building surface panel is no more than 4 inches, e.g., no more than 3.5 inches, e.g., no more than 3 inches. For example, in some embodiments, the thickness of the building surface panel is in a range of ½ inch to 4 inches, e.g., from ⅝ inch to 3.5 inches, e.g., from ¾ inch to 3 inches.

The building surface panels of the present disclosure are described with reference to a horizontal orientation, as shown in 1D, where the fastening strip is at the upper side, with respect to gravity, of the building surface panel. In connection with this orientation, certain features are described as being upper or lower, or extending upward or downward. However, the building surface panels of the disclosure may also be oriented vertically or diagonally, in which case the described upper and lower directions are not aligned with gravity. For instance, regardless of the orientation of the building surface panel with respect to gravity, i.e., horizontal, vertical, or diagonal, the upward direction of the building surface panel is the direction that extends from the overhang toward the fastening strip and the downward direction is opposite the upward direction. Likewise, the term upper relates to this upward direction and the term lower relates to the downward direction.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A building surface panel having a first end, a second end, an upper side, and a lower side, the building surface panel comprising:

a hollow panel body including a front wall at a front side of the building surface panel and a rear wall at a rear side of the building surface panel that enclose an interior space;

a fastening strip attached to the panel body and extending along the upper side of the building surface panel, wherein the fastening strip and the rear wall of the panel body form a rear attachment surface of the building surface panel that is configured to engage a support structure;

an overhang attached to the panel body and extending along the lower side of the building surface panel, the overhang being configured to overlap at least a portion of a fastening strip of a lower neighboring building surface panel having a similar configuration, wherein the overhang and the front wall of the panel body form an exposed front surface of the building surface panel, a rear-facing engagement surface disposed at the upper side of the building surface panel; and a front-facing engagement surface disposed at the lower side of the building surface panel, the front facing engagement surface being configured to engage a rear facing engagement surface of the lower neighboring building surface panel, wherein an upper side of the panel body includes a first angled surface at the front side of the building surface panel and a lower side of the overhang includes a second angled surface at the front side of the building surface panel, the first and second angled surfaces are configured such that, when the front-facing engagement surface of the building surface panel engages a rear-facing engagement surface of the lower neighboring building surface panel, a front-facing V-groove is formed between the second angled surface of the building surface panel and a first angled surface of a lower neighboring building surface panel having the same configuration.

2. The building surface panel according to claim 1, wherein the panel body includes a lower projection that extends downward behind the overhang, and wherein the front-facing engagement surface is formed on the lower projection of the panel body.

3. The building surface panel according to claim 2, wherein the upper projection of the fastening strip extends outward at an angle to the attachment section.

4. The building surface panel according to claim 2, wherein the lower projection is formed by an angled lower wall of the panel body.

5. The building surface panel according to claim 2, further comprising a lower flange extending downward from the overhang, and wherein the front-facing engagement surface is formed on the lower flange.

6. The building surface panel according to claim 5, wherein the panel body includes a channel, and wherein the rear-facing engagement surface is formed in the channel.

7. The building surface panel according to claim 2, wherein the fastening strip is hollow.

8. The building surface panel according to claim 7, wherein the fastening strip includes a channel configured to receive a fastener for securing the building surface panel to a support structure.

9. The building surface panel according to claim 1, wherein the fastening strip includes:

an attachment section that forms a portion of the rear attachment surface of the building surface panel, and an upper projection that extends upward from the attachment section and forward from the rear attachment surface, and wherein the rear-facing engagement surface is formed on the upper projection.

10. The building surface panel according to claim 9, wherein the lower projection is formed by a flange.

11. The building surface panel according to claim 10, wherein a portion of the upper projection of the fastening strip extends vertically and is offset from the rear attachment surface so as to provide a pocket behind the upper projection.

12. The building surface panel according to claim 9, wherein the upper projection is configured to vertically support an upper neighboring building surface panel.

13. The building surface panel according to claim 1, further comprising a lower hook extending upward from a rear side of the overhang, and wherein the front-facing engagement surface is formed on the lower hook.

14. The building surface panel according to claim 13, wherein the fastening strip includes an upper hook with a downwardly extending hook end, and wherein the rear-facing engagement surface is formed on the hook end.

15. The building surface panel according to claim 1, wherein the fastening strip includes a slot configured to receive a fastener for securing the building surface panel to a support structure.

16. The building surface panel according to claim 1, wherein a length of the building surface panel is at least 4 feet and no more than 30 feet; a width of the building surface panel is at least 4 inches and no more than 3 feet; and a thickness of the building surface panel is at least ½ inch and no more than 4 inches.

17. A building surface system comprising:

a support structure;

an upper building surface panel and a lower building surface panel, each according to claim 1 and each secured to the support structure; and wherein the front-facing engagement surface at the lower side of the upper building surface panel is secured against the rear-facing engagement surface at the upper side of the lower building surface panel, and wherein the first angled surface of the panel body of the lower building surface panel forms a V-groove with the second angled surface of the upper building surface panel.

18. The building surface system according to claim 17, wherein the panel body of the lower building surface panel engages an overhang of the upper building surface panel so as to provide vertical support to the upper neighboring building surface panel.

19. A building surface panel having a first end, a second end, an upper side, and a lower side, the building surface panel comprising:

a hollow panel body including a front wall at a front side of the building surface panel and a rear wall at a rear side of the building surface panel that enclose an interior space;

a fastening strip attached to the panel body and extending along the upper side of the building surface panel, wherein the fastening strip and the rear wall of the panel body form a rear attachment surface of the building surface panel that is configured to engage a support structure;

an overhang attached to the panel body and extending along the lower side of the building surface panel, the overhang having a lower end, the overhang being configured to overlap at least a portion of a fastening strip of a lower neighboring building surface panel having a similar configuration, wherein the overhang and the front wall of the panel body form an exposed front surface of the building surface panel, a rear-facing engagement surface disposed at the upper side of the building surface panel; and a front-facing engagement surface disposed at the lower side of the building surface panel, the front facing engagement surface being configured to engage a rear facing engagement surface of the lower neighboring building surface panel, wherein the building surface panel is configured such that when the front-facing engagement surface of the building surface panel engages a rear-facing engagement surface of the lower neighboring building surface panel, the lower end of the overhang is disposed in front of the lower neighboring building surface panel.

20. A building surface system comprising:

a support structure;

an upper building surface panel and a lower building surface panel, each according to claim 19 and each secured to the support structure; and wherein the front-facing engagement surface at the lower side of the upper building surface panel is secured against the rear-facing engagement surface at the upper side of the lower building surface panel, and wherein the lower end of the overhang is disposed in front of the lower neighboring building surface panel.

* * * * *